US005938423A

United States Patent [19]

Nishiyama et al.

[11] Patent Number: 5,938,423

[45] Date of Patent: Aug. 17, 1999

[54] METHOD AND APPARATUS FOR CONTROLLING COMBUSTION USING AN OXYGEN SENSOR

[75] Inventors: Tomohiko Nishiyama; Kazuhisa Mitani, both of Toyota; Yukio Fukuta, Yokkaichi, all of Japan

[73] Assignee: Toyota Jidosha Kabushiki Kaisha, Toyota, Japan

[21] Appl. No.: 08/859,852

[22] Filed: May 21, 1997

[30] Foreign Application Priority Data

| | | | |
|---|---|---|---|
| May 22, 1996 | [JP] | Japan | 8-127158 |
| May 23, 1996 | [JP] | Japan | 8-128437 |
| Sep. 26, 1996 | [JP] | Japan | 8-255118 |
| Nov. 5, 1996 | [JP] | Japan | 8-292352 |

[51] Int. Cl.[6] ..... F23H 5/00

[52] U.S. Cl. ..... 431/12; 431/76

[58] Field of Search ..... 431/76, 12

[56] References Cited

U.S. PATENT DOCUMENTS

| | | | |
|---|---|---|---|
| 4,199,425 | 4/1980 | Sinkevitch | 204/429 |
| 4,392,818 | 7/1983 | Wunning . | |
| 4,437,971 | 3/1984 | Csanitz et al. | 204/428 |
| 4,447,204 | 5/1984 | Isenberg . | |
| 4,516,929 | 5/1985 | Hiroi et al. | 431/76 |
| 4,586,476 | 5/1986 | Asayama et al. . | |
| 4,956,072 | 9/1990 | Kojima et al. | 204/428 |
| 5,037,761 | 8/1991 | Barnett . | |
| 5,120,214 | 6/1992 | West et al. | 431/76 |
| 5,203,983 | 4/1993 | Ohyama et al. | 204/428 |
| 5,423,972 | 6/1995 | Mann et al. | 204/428 |
| 5,431,147 | 7/1995 | Tanaka et al. | 431/215 |
| 5,443,040 | 8/1995 | Kaji et al. | 431/215 |
| 5,589,627 | 12/1996 | Sutton | 431/76 |
| 5,628,629 | 5/1997 | Mitani et al. . | |
| 5,679,226 | 10/1997 | Furusaki et al. | 204/428 |

FOREIGN PATENT DOCUMENTS

| | | |
|---|---|---|
| 121437 | 10/1984 | European Pat. Off. . |
| 396 164 | 11/1990 | European Pat. Off. . |
| 628 769 A1 | 12/1994 | European Pat. Off. . |
| 661 497 A2 | 7/1995 | European Pat. Off. . |
| 33 13 783 A1 | 10/1983 | Germany . |
| 2-254210 | 10/1990 | Japan . |
| 4-050647 | 2/1992 | Japan . |
| 4-270819 | 9/1992 | Japan . |
| 6-221545 | 8/1994 | Japan . |
| 2 022 263 | 12/1979 | United Kingdom . |

OTHER PUBLICATIONS

Tsuruta Kunihiro, Kondo Kenji, "Combustion Equipment", 07324733, Patent Abstracts of Japan, vol. 096, No. 004, Apr. 30, 1996.

Tsuruta Kunihiro, "Combustion Apparatus", 07293870, Patent Abstracts of Japan, vol. 096, No. 003, Mar. 29, 1996.

Tsuruta Kunihiro, Nagai Takeshi, Umeda Takahiro, "Combustion Equipment", 06323530, Patent Abstracts of Japan, vol. 095, No. 002, Mar. 31, 1995.

Patent Abstracts Of Japan, vol. 096, No. 004, Apr. 30, 1996 & JP 07 324733 A (Matsushita Electric Ind. Co. Ltd.), Dec. 12, 1995.

Patent Abstracts Of Japan, vol. 096, No. 003, Mar. 29, 1996 & JP 07 293870 A (Matsushita Electric Ind. Co. Ltd.), Nov. 10, 1995.

Patent Abstracts Of Japan, vol. 095, No. 002, Mar. 31, 1995 & JP 06 323530 A (Matsushita Electric Ind. Co. Ltd.), Nov. 25, 1994.

*Primary Examiner*—Carroll Dority

*Attorney, Agent, or Firm*—Pillsbury Madison & Sutro LLP

[57] ABSTRACT

A combustion control method includes the steps of providing an oxygen sensor within a furnace or at a flue of the furnace, detecting an oxygen concentration of exhaust gas, and controlling an air ratio. A regenerative combustion apparatus includes a regenerative combustion burner, an oxygen sensor disposed in an air supply and gas exhaust passage of the burner. A combustion control method and apparatus includes the steps of switching an electrical voltage imposed on an oxygen sensor between a first electrical voltage and a second electrical voltage near 0 V, conducting an air ratio control when the imposed voltage is at the first voltage and monitoring unburnt components included in exhaust gas when the imposed voltage is at the second voltage.

20 Claims, 11 Drawing Sheets

IN SINGLE-TYPE REGENERATIVE COMBUSTION BURNER

METHOD AND APPARATUS FOR CONTROLLING COMBUSTION USING AN OXYGEN SENSOR

This application is based on application Nos. HEI 8-127158 filed in Japan on May 22, 1996, HEI 8-128437 filed in Japan on May 23, 1996, HEI 8-255118 filed in Japan on Sep. 26, 1996 and HEI 8-292352 filed in Japan on Nov. 5, 1996, the contents of which are incorporated herein by reference.

BACKGROUND OF THE INVENTION

1. Field of the Invention

The present invention relates to a method and apparatus for controlling combustion of a furnace and/or a burner using an oxygen sensor.

2. Description of Related Art

The general combustion control methods for a furnace and/or a regenerative combustion system are the following:

(1) a method wherein fuel and air are supplied and cut off by operating solenoid valves installed in the fuel system and the air supply system, (2) a method wherein supply amounts of fuel and air are controlled by the respective pressure control valves installed in respective systems which are correlated with each other in operation, and (3) a method wherein the pressure control valves are replaced by flow control valves in the above method.

In the above, the regenerative combustion system is a system known by, for example, Japanese Patent Publication HEI 4-270819. In that system, high temperature exhaust gas is exhausted through a heat storage member, and most of the heat of the exhaust gas is stored in the heat storage member. When gas exhaust and air supply are switched and supply air passes through the heat storage member, the heat stored in the heat storage member is released to heat the supply air. Due to this, the thermal efficiency of the system is greatly improved.

However, in any of the above-described methods, an attempt to raise accuracy of the control will be accompanied by complication and increase in cost of the system.

To raise accuracy of the control, it would be effective to control an air ratio based on an oxygen concentration of exhaust gas. However, conventional sensors have the problems that they are expensive and it is difficult to find degradation of or damage to the sensor.

Particularly, with the regenerative combustion system, there is a problem that because the air ratio is likely to vary due to (a) blockade of the heat storage member, (b) leakage of supply air to exhaust gas in the air supply and gas exhaust switching mechanism, and/or (c) pressure change accompanying the temperature change, it is difficult to operate the system at an optimum air ratio for a long time period.

Further, control of the air ratio based on the oxygen concentration in the exhaust gas cannot provide inspection of concentrations of unburnt components such as carbon monoxide and hydrocarbons included in the exhaust. Therefore, even if the air ratio is controlled, unburnt components more than an allowable limit may be included in the exhaust gas. To prevent the unburnt components from being exhausted to the atmosphere, it would be necessary to provide some device for detecting the amount of the unburnt components, which will increase the cost of the combustion control system.

SUMMARY OF THE INVENTION

A first object of the present invention is to provide a combustion control method capable of controlling an air ratio based on a concentration of oxygen, which is reliable and of a low cost.

A second object of the present invention is to provide a regenerative combustion apparatus capable of operating at a substantially optimum air ratio.

A third object of the present invention is to provide a method and apparatus for controlling combustion of a burner, capable of both controlling an air ratio and inspecting unburnt components included in exhaust gas.

A method according to the present invention for achieving the above-described first object is as follows:

(A) A combustion control method comprising the steps of:

providing an oxygen sensor of the type capable of detecting an oxygen concentration by an electric current generated in the oxygen sensor in one of a furnace and a flue of the furnace and detecting the oxygen concentration of the gas in said one of the furnace and the flue by the electric current signal generated from the oxygen sensor; and controlling an air ratio based on the detected oxygen concentration.

An apparatus according to the present invention for achieving the above-described second object is as follows:

(B) A combustion control apparatus for a regenerative combustion apparatus comprising:

a regenerative combustion burner;

air supply and gas exhaust passages connected to the regenerative combustion burner; and an oxygen sensor disposed in one of the regenerative combustion burner and the air supply and gas exhaust passages.

A method and apparatus according to the present invention for achieving the above-described third object is as follows:

(C) A combustion control method for a burner using an oxygen sensor comprising the steps of:

controlling an imposed electrical voltage of the oxygen sensor which includes a solid electrolyte to an electrical voltage equal to or near 0; and monitoring a concentration of unburnt components included in exhaust gas of burner combustion based on an output electrical current of the oxygen sensor.

(D) A combustion control apparatus for a burner using an oxygen sensor, comprising:

an oxygen sensor including a solid electrolyte;

an imposed electrical voltage switching device constructed and arranged to switch an electrical voltage imposed on the oxygen sensor between a first electrical voltage used when controlling an air ratio and a second electrical voltage used when inspecting unburnt components, the second electrical voltage being equal to or near 0; and a monitoring device constructed and arranged to monitor a concentration of unburnt components included in exhaust gas according to a negative output electrical voltage of the oxygen sensor when the electrical voltage imposed on the oxygen sensor is at the second electrical voltage.

In the above-described method (A), since the oxygen concentration is detected by an oxygen sensor on the basis of an output electrical current, the automobile oxygen sensor can be used for the sensor. As a result, a decrease in cost, a compact size, improvement of response and improvement of reliability for the control system can be achieved.

In the above-described apparatus (B), utilizing the phenomenon that burnt fuel gas returns to the regenerative combustion burner, the oxygen sensor is disposed in the burner or the exhaust passage and the oxygen concentration in the exhaust gas is detected by the oxygen sensor. Due to this, the air ratio can be controlled optimumly and stably. Further, in the case where the apparatus is provided with a self inspection device, degradation of the sensor, blockage of the heat storage member, leakage of the switching mechanism and a blower failure can be self-inspected.

In the above-described method (C) and apparatus (D), whether the amount of unburnt components included in the exhaust gas is large or small can be monitored using the same oxygen sensor as the sensor used for the air ratio control, by maintaining the imposed electrical pressure to be substantially 0 V and based on the output electrical current of the sensor. Therefore, another particular sensor does not need to be provided.

BRIEF DESCRIPTION OF THE DRAWINGS

The above and other objects, features, and advantages of the present invention will become more apparent and will more readily appreciated from the following detailed description of the preferred embodiments of the present invention in conjunction with the accompanying drawings, in which.

DETAILED DESCRIPTION OF THE PREFERRED EMBODIMENTS

Figure 1A:
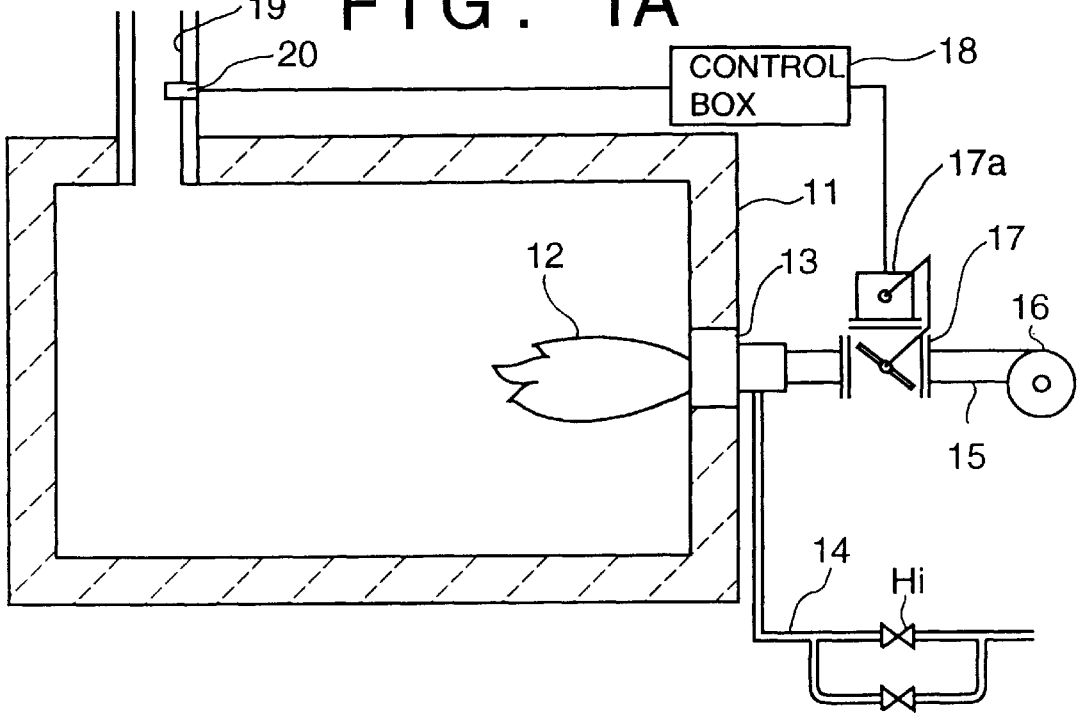
FIG. 1A is a schematic cross-sectional view of an apparatus for conducting combustion control methods according to a first embodiment and a third embodiment of the present invention.

A first embodiment of the present invention relates to a combustion control method of a furnace using an oxygen sensor and is illustrated in FIG. 1A and FIGS. 2–7.

A second embodiment of the present invention relates to a combustion control apparatus of a regenerative combustion apparatus using an oxygen sensor and is illustrated in FIG. 1B, FIGS. 2–7, and FIGS. 8–13.

A third embodiment of the present invention relates to a combustion control method and apparatus for a burner (which may be a regenerative combustion burner or a usual burner) and is illustrated in FIGS. 1A and 1B, FIG. 6, 8, and 9, and FIGS. 14–19.

Portions common or similar to all of the embodiments of the present invention are denoted with the same reference numerals throughout all of the embodiments of the present invention.

FIRST EMBODIMENT

First, a combustion control method of a furnace according to the first embodiment will be explained with reference to FIG. 1A and FIGS. 2–7.

As illustrated in FIG. 1A, a furnace 11 is provided with a burner 13. A fuel (for example, gaseous fuel) supply system 14 and an air supply system 15 are connected to the burner 13. When burned, the fuel forms a flame 12. The air supply system 15 includes a blower 16 and a control valve 17 disposed in a line connecting the blower 16 and the burner 13. An opening degree of the control valve 17 is controlled by a signal sent from a control box 18. Within the furnace 11 or at a flue 19 of the furnace, is an oxygen sensor 20 for detecting a concentration of oxygen included in fuel-burnt gas. The output electrical signal of the oxygen sensor is fed to a control motor 17*a* of the control valve 17. The opening degree of the control valve 17 is controlled so that the amount of supply air approaches a predetermined objective supply air amount.

Figure 2:
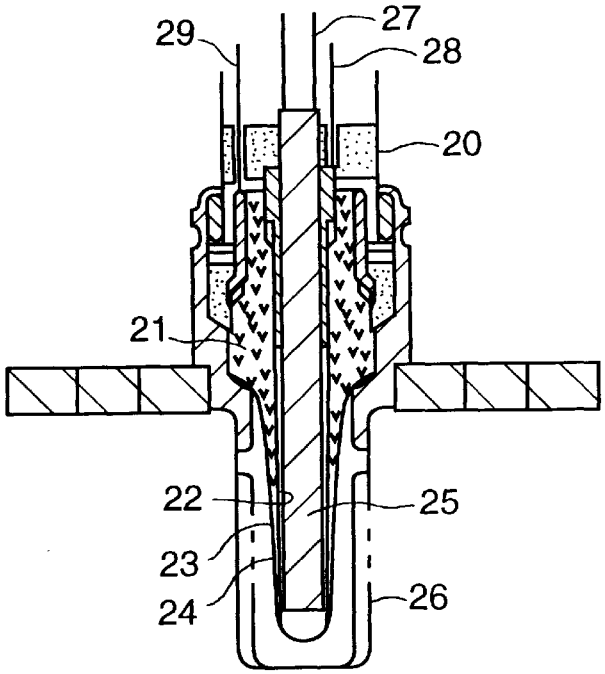
FIG. 2 (PRIOR ART)
FIG. 2 is a cross-sectional view of an oxygen sensor used in the first embodiment, the second embodiment and the third embodiment of the present invention.

The oxygen sensor 20 is a sensor of the type of detecting an oxygen concentration according to an output electrical current. The structure of the oxygen sensor 20 is illustrated in FIG. 2. The oxygen sensor 20 includes a zirconia solid electrolyte 21 formed in the shape of a test tube, platinum electrodes 22 and 23 formed on the inside surface and the outside surface of the zirconia solid electrolyte 21, respectively, a heater 25 for maintaining the temperature of the detecting portion (including portions 21, 22, 23 and 24) at a temperature higher than 650° C., and a protection cover 26 disposed outside of the detecting portion. The oxygen sensor 20 further includes a heater lead 27, an inside electrode lead 28 and an outside electrode lead 29.

A principle for detecting an oxygen concentration detection by the oxygen sensor 20 will be explained with reference to FIGS. 3–6.

Figure 5:
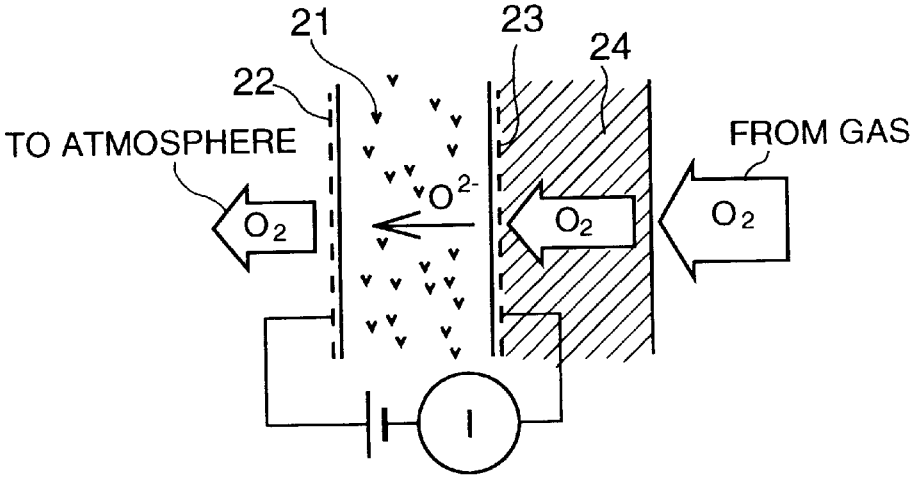
FIG. 5 is a cross-sectional view of a solid electrolyte and a portion close to the solid electrolyte of the oxygen sensor used in the second embodiment and the third embodiment of the present invention illustrating a principle for detecting an oxygen concentration.
Figure 6:
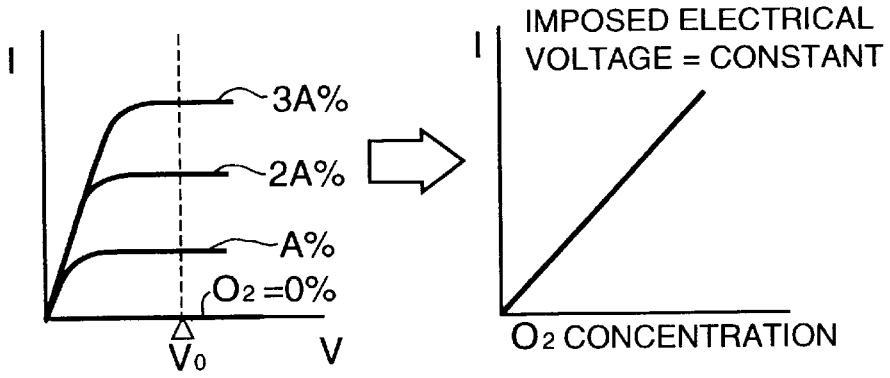
FIG. 6 illustrates a relationship between an output electrical current and an imposed electrical voltage and a relationship between an output electrical current and an oxygen concentration in the method and apparatus according to the first embodiment, the second embodiment and the third embodiment of the present invention.

When an electrical voltage is imposed on the zirconia solid electrolyte 21 at a temperature above 650° C., as illustrated in FIG. 5, movement of oxygen ions is generated in the zirconia solid electrolyte 21. The movement of oxygen ions is detected as an electrical current. The electrical current increases according to an increase in the imposed electrical voltage. However, when a diffusion control layer 24 is provided on the cathode side, even if the imposed electrical voltage is increased, the output electrical current causes saturation at a certain value as shown in FIG. 6. In the range where the electrical current is in saturation, at a constant electrical voltage ($V_0$), the oxygen concentration and the saturated output electrical current are in a linear relationship with each other, as illustrated in FIG. 6.

Figure 3:
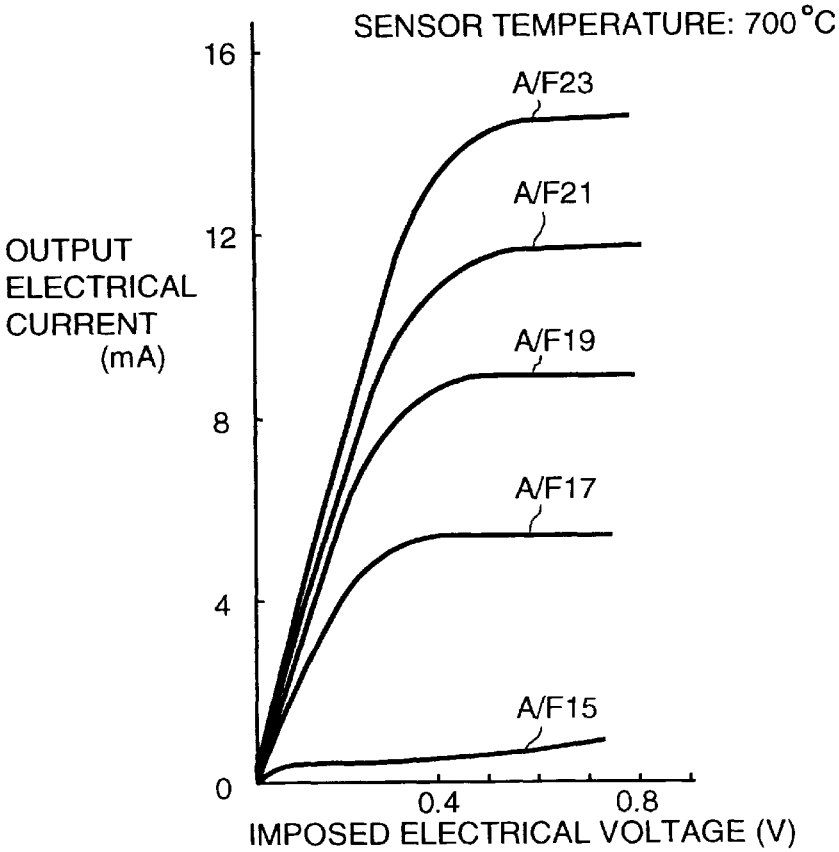
FIG. 3 is a graph illustrating a relationship between an output electrical current (mA) and an imposed electrical voltage (V) of the oxygen sensor of FIG. 2.
Figure 4:
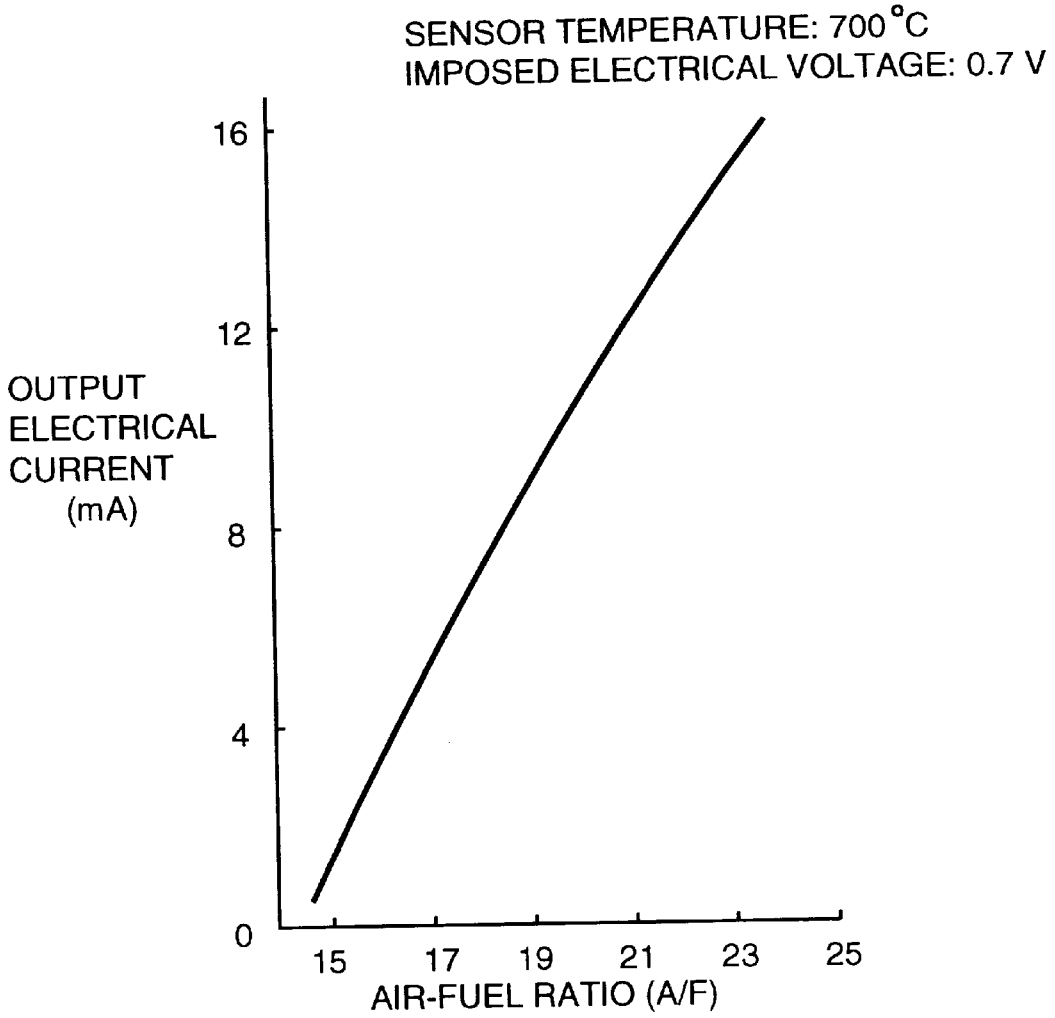
FIG. 4 is a graph illustrating a relationship between an output electrical current (mA) and an air-fuel ratio (air/fuel) of the oxygen sensor of FIG. 2.

The output characteristic of the oxygen sensor 20 of FIG. 2 is as shown in FIG. 3 as discussed using FIGS. 5 and 6. A stable saturated electrical current characteristic is obtained over a wide range of air-fuel ratio. For example, FIG. 4 illustrates the output electrical current characteristic in the case where the temperature of the detecting portion of the sensor is 700° C. and the imposed electrical voltage is 0.7 V. As can be seen from FIG. 7, a linear characteristic is obtained at an air rich condition. FIGS. 3 and 4 illustrate characteristics obtained when the oxygen sensor is used in an internal combustion engine, and the air-fuel ratio is a value based on gasoline. The region of FIG. 4 is a region where the air-fuel ratio is greater than the stoichiometric air-fuel ratio and therefore is in an air rich environment.

Usually, combustion in the furnace using a burner is conducted not at a gas rich environment but at an air rich environment. In this instance, combustion is conducted at an excess of oxygen which is more than the value necessary at the stoichiometric air-fuel ratio and 21% at most. Therefore, the combustion environment is in the operable range of the oxygen sensor 20. By conducting a feed-back control from the oxygen sensor 20 to the control motor 17*a* of the control valve 17, combustion at a low oxygen concentration close to a limit at which unburnt components begin to be caused is possible.

A combustion method according to a first embodiment of the present invention conducted using the above-described apparatus includes the steps of: (a) providing the oxygen sensor 20 of the type capable of detecting an oxygen concentration by an electric current generated in the oxygen sensor 20 in the furnace or the flue of the furnace, and detecting the oxygen concentration of the gas in the furnace or the flue by the electric current signal generated from the oxygen sensor; and (b) controlling an air ratio (a ratio of an amount of supply air to an amount of the theoretical air amount needed in perfect combustion) based on the detected oxygen concentration. In this instance, the object to be controlled is an air amount, which may be expressed as a control of the air ratio or as a control of the air-fuel ratio.

In the combustion control method, a lean mixture sensor or an improved one thereof used for an automobile can be used as the oxygen sensor 20. Such an automobile oxygen sensor is manufactured through mass-production and is of a relatively low cost. Further, the automobile oxygen sensor is compact and does not cause a problem from the viewpoint of space when it is mounted to the furnace and the flue. Furthermore, the automobile oxygen sensor is a sensor of the type that issues an electrical current output and has a good response and a high reliability.

One example of combustion in a furnace using a burner will be explained below, wherein a high combustion (HI) and a low combustion (LO) are switched at a predetermined temperature and the low combustion (LO) and a combustion conducted by cutting off a main fuel (OFF) are switched at the predetermined temperature plus $\alpha$ (a small positive value).

(1) While starting up the furnace from a cold state:

HI or LO combustion is conducted. The control motor is fully open. The oxygen sensor 20 is not operated until the temperature rises to a predetermined temperature or a predetermined time period has elapsed. At the predetermined temperature, the amount of supply air begins to be controlled by the oxygen sensor and its feed-back control.

(2) When switching the operation from HI to LO:

The operation is switched to LO, maintaining the control motor constant so that carbon monoxide generated due to imperfect combustion is not exhausted to the atmosphere. Then, the amount of supply air is controlled by the oxygen sensor 20.

(3) When switching the operation from LO to OFF:

The main fuel is cut off. Then, a preferable amount of air is supplied, controlling the amount of air by the control motor thereby purging the furnace.

(4) When switching the operation from OFF to LO:

After operating the control motor so as to fully open the control valve, LO combustion is ignited and conducted so that carbon monoxide generated due to imperfect combustion is not exhausted to the atmosphere. Then, the amount of supply air is controlled by the oxygen sensor 20.

(5) When switching the operation from LO to HI:

After operating the control motor so as to fully open the control valve, HI combustion is ignited and conducted so that carbon monoxide generated due to imperfect combustion is not exhausted to the atmosphere. Then, the amount of supply air is controlled by the oxygen sensor 20.

Due to the above-described combustion, both combustion at low amount of oxygen within an oxygen concentration limit that generates no unburnt components and suppression of exhaust of carbon monoxide to the atmosphere are satisfied.

Figure 7:
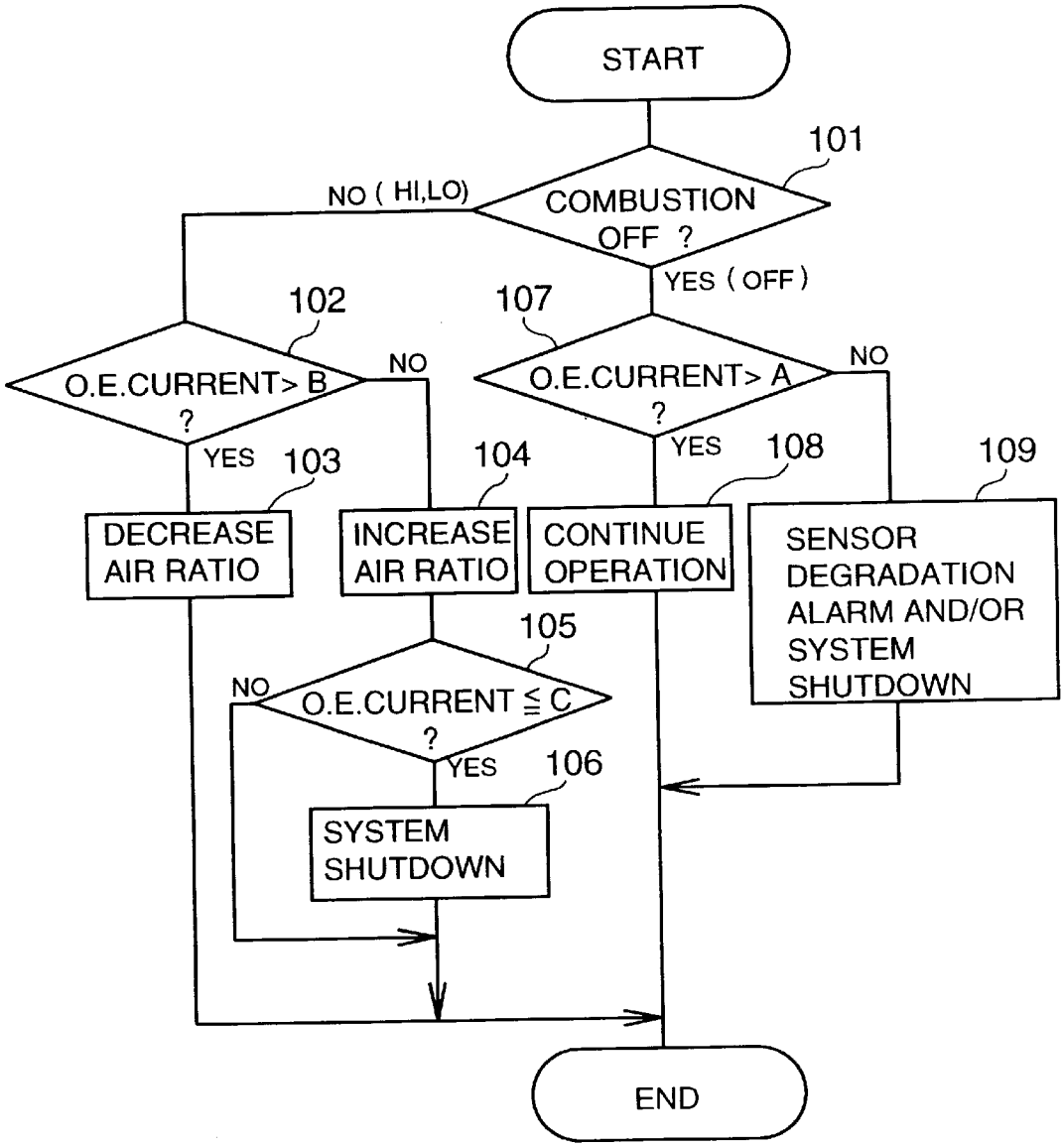
FIG. 7 is a flow chart of a combustion control routine having a self inspecting function for the method and the apparatus according to the first embodiment and the second embodiment of the present invention.

FIG. 7 illustrates a combustion control method wherein self-inspection of the amount of degradation of the oxygen sensor 20 and any trouble with the combustion apparatus, etc., is conducted in the above-described combustion control method and air ratio control method. The control routine or the self-inspecting device of FIG. 7 is stored in the control box 18 (for example, a computer) as one may see illustrated in FIGS. 1A and 1B.

The self-inspecting device includes a first portion 101 constructed and arranged to determine whether combustion is OFF, a second portion 102 constructed and arranged to determine whether an output electric current of the oxygen sensor 20 is greater than predetermined value B when the first portion determines that combustion is not OFF, a third portion 103 constructed and arranged to instruct a decrease in an amount of supply air when the second portion determines that the output electric current of the oxygen sensor 20 is greater than the predetermined value B, a fourth portion 104 constructed and arranged to instruct an increase in the amount of supply air when the second portion determines that the output electric current of the oxygen sensor 20 is equal to or less than the predetermined value B, a fifth portion 105 constructed and arranged to determine whether the output electric current of the oxygen sensor 20 is equal to or less than predetermined value C which is smaller than the value B after the fourth portion instructs, a sixth portion 106 constructed and arranged to instruct a system shutdown when the fifth portion determines that the output electric current of the oxygen sensor 20 is equal to or less than predetermined value C, a seventh portion 107 constructed and arranged to determine whether the output electric current of the oxygen sensor 20 is greater than predetermined value A which is greater than the value B when the first portion determines that combustion is OFF; an eighth portion 108 constructed and arranged to instruct continuance of operation when the seventh portion determines that the output electric current of the oxygen sensor 20 is greater than predetermined value A, and a ninth portion 109 constructed and arranged to express that the oxygen sensor 20 has degraded and, as necessary, to instruct a system shutdown when the seventh portion determines that the output electric current of the oxygen sensor 20 is equal to or less than predetermined value A.

The routine of FIG. 7 is entered at intervals of a predetermined time period ΔT. At step 101, a decision is made as to whether or not combustion is in the OFF state (when not, the combustion is in the HI or LO state). When the combustion is OFF and the blower is ON, the interior of the furnace and the flue is in the state of an air rich condition (i.e., the concentration of oxygen is high). Contrarily, when the combustion is HI or LO, the interior of the furnace and the flue is in the state where the concentration of oxygen is low.

When it is determined at step 101 that the combustion is HI or LO, the routine proceeds to step 102, where a decision is made as to whether or not the output electrical current of the oxygen sensor is greater than predetermined value B (for example, 3 mA). When the output electrical current is greater than B, which means that the amount of supply air is too large, the routine proceeds to step 103, where an instruction to rotate the control valve in a closing direction is issued thereby decreasing the amount of supply air. Then, the routine proceeds to the END step. When the output electrical current is less than B, which means that the amount of supply air is too small, the routine proceeds to step 104, where an instruction to rotate the control valve in an opening direction is issued thereby increasing the amount of supply air. Then, the routine proceeds from step 104 to step 105, where a decision is made as to whether or not the output electrical current of the oxygen sensor 20 is equal to or smaller than a predetermined lower limit value C which is smaller than B. When it is determined in step 105 that the output electrical current is greater than C, the routine proceeds to the END step. When it is determined at step 105 that the output electrical current is equal to or smaller than the value C, it means that despite the instruction at step 104 to increase the amount of supply air, the amount of supply air does not increase. This means that some trouble (for example, trouble with the blower, etc.) has occurred in the air supply system. So, the routine proceeds to step 106 where the system shutdown (stopping of combustion) is instructed. To pass through the route of step 106 means to self-inspect because some trouble has occurred in the system, and the route of step 106 constitutes a portion of a self-inspection device.

When it is determined at step 101 that combustion is OFF and the blower is ON, the interior of the furnace and the flue is presumed to be in an air rich condition. So, the routine proceeds to step 107 where a decision is made as to whether or not the output electrical current of the oxygen sensor 20 is greater than predetermined value A (which is greater than value B and is, for example, 35 mA).

When the routine proceeds to step 107, the main fuel is OFF and air is supplied. Therefore, the interior of the furnace and the flue is in an air rich condition. So, so long as the oxygen sensor 20 is normal, the output electrical current of the sensor 20 will be greater than the value A. Therefore, when it is determined at step 107 that the output electrical current of the sensor 20 is greater than the value A, the routine proceeds to step 108 where instruction to continue the instant operation is issued. Then, the routine proceeds to the END step.

However, when it is determined at step 107 that the output electrical current of the oxygen sensor is equal to or less than value A, it means that despite the air rich condition of the interior of the furnace and of the flue, the oxygen sensor 20 cannot issue a large output proportional to the amount of oxygen. This means that the oxygen sensor 20 itself has been degraded. Therefore, the routine proceeds to step 109, where an alarm for expressing the degradation of the sensor is issued, and if necessary, the system shutdown (stopping combustion) is instructed. However, even if the sensor has been degraded, the system shutdown does not need to be conducted immediately. Therefore, the system shutdown may be conducted after some period of time has elapsed after the alarm issues, or by fully opening the control valve (namely, without controlling the oxygen and maintaining the oxygen rich condition), operation of the furnace may be continued and only the sensor is replaced by a new one during the operation. To pass through the route of step 109 means to self-inspect because some trouble has occurred in the oxygen sensor 20 and the route of step 109 constitutes a portion of the self-inspection device.

By providing the system with the self-inspection device, reliability of the combustion control operation is improved. Further, even if some trouble happens, the kind of trouble (whether the trouble is trouble due to the system or the sensor) can be recognized, and so the most appropriate remedy to the trouble can be taken. Further, the inspection can be conducted at any time during operation of the system and does not require that the system be stopped.

According to the method according to first embodiment of the present invention, the following technical advantages are obtained:

First, since detection of the concentration of oxygen is based on the oxygen sensor based on an output electrical current, an automobile oxygen sensor can be used for such sensor. As a result, a decrease in cost, a compact size, high response and improvement of reliability can be achieved.

Second, in the case where a self-inspection device is provided, degradation of the sensor and trouble with the combustion apparatus can be self-inspected. As a result, reliability of combustion control is improved.

SECOND EMBODIMENT

A combustion control apparatus of a regenerative combustion apparatus using an oxygen sensor according to the second embodiment of the present invention will be explained with reference to FIG. 1B, FIGS. 2–7 (FIGS. 2–7 are common with the first embodiment), and FIGS. 8–13.

Figure 1B:
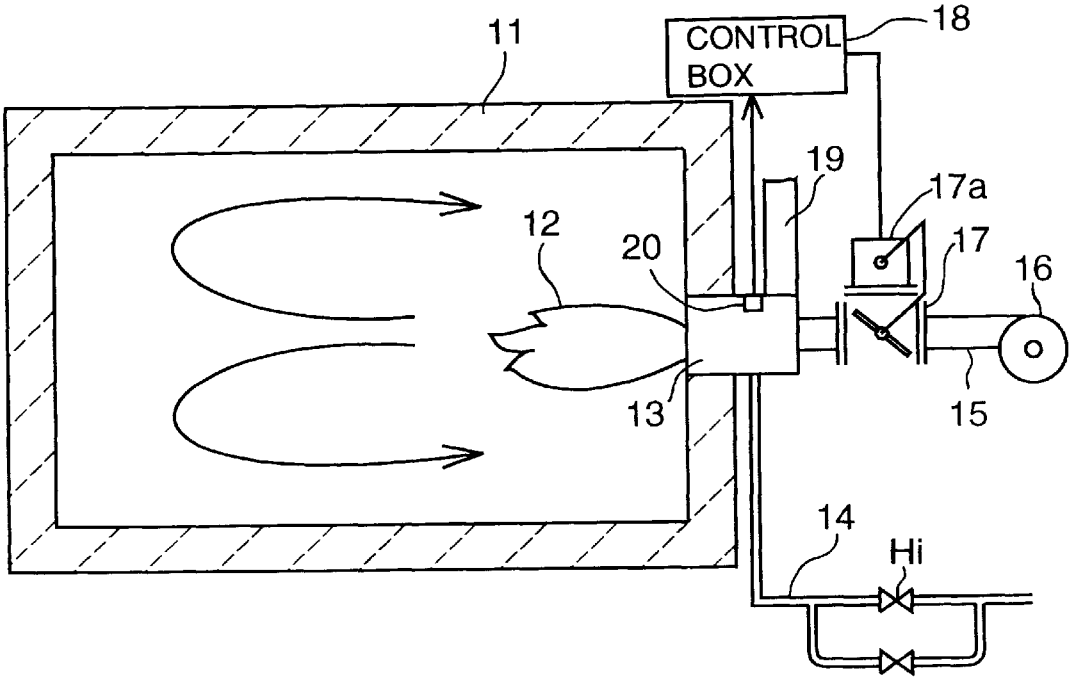
FIG. 1B is a schematic cross-sectional view of a regenerative combustion apparatus according to a second embodiment and the third embodiment of the present invention.

In FIG. 1B, the furnace 11 is provided with a regenerative combustion burner 13. A fuel supply system 14 (the fuel is, for example, gaseous fuel), an air supply system 15 and a gas exhaust system 19 are connected to the regenerative combustion burner 13. In the furnace, a flame 12 is formed. In the air supply system, a blower 16 for feeding air for combustion to the regenerative combustion burner 13 is provided, and in a passage connecting the blower 16 and the regenerative combustion burner 13 a control valve 17 is provided. The opening degree of the control valve 17 is controlled by the signal from a control box 18.

In the regenerative combustion burner 13 or in the air supply system 15 or the gas exhaust system 19, an oxygen sensor 20 for detecting a concentration of oxygen included in fuel burnt gas is provided. The output electrical signal of the oxygen sensor is fed to the control box 18 where the necessary mount of supply air corresponding to the output electrical current of the sensor is calculated. Then, the output signal is fed to a control motor 17*a* of the control valve 17 so that the amount of supply air approaches the necessary supply air amount.

Figure 8:
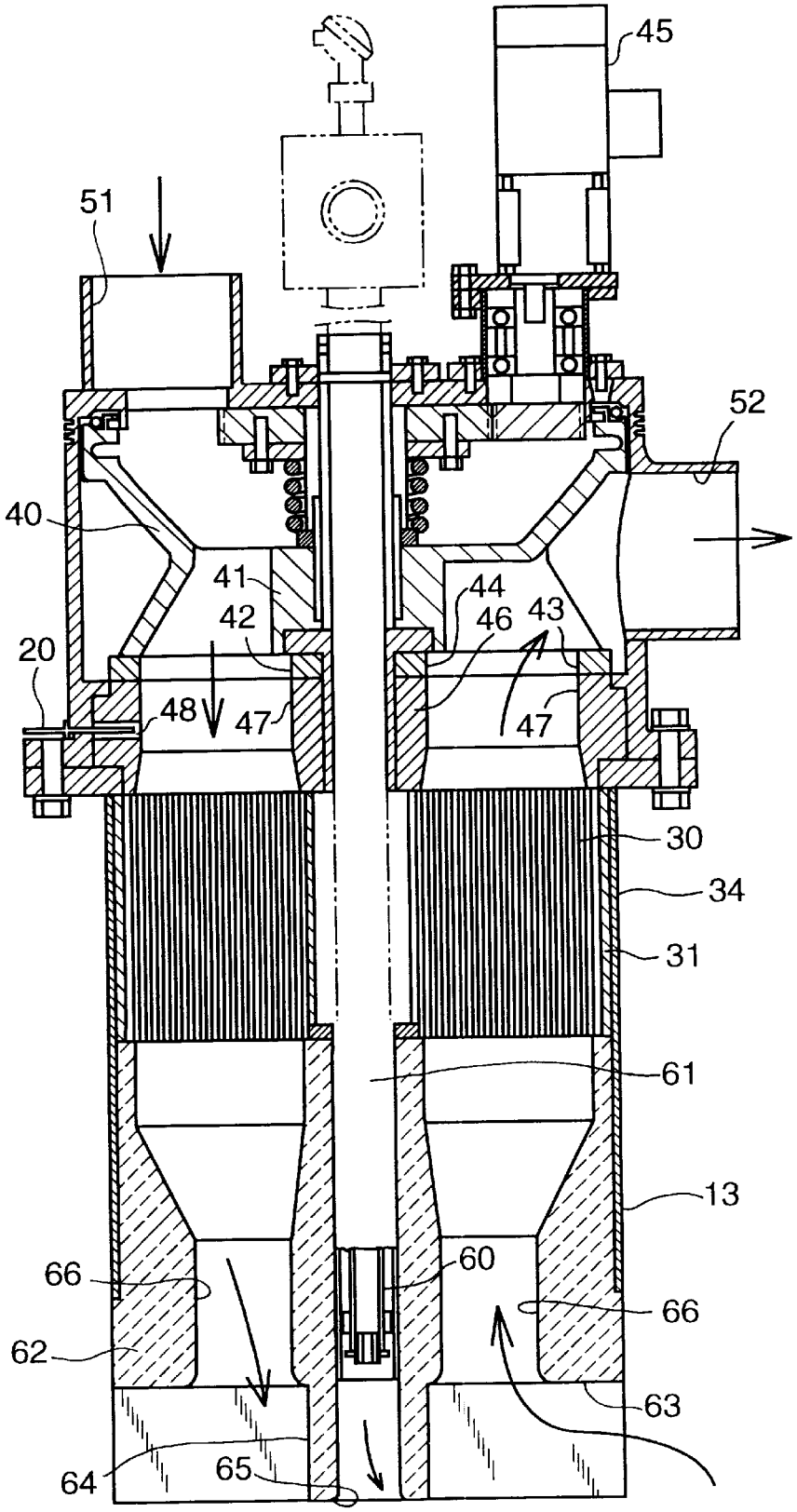
FIG. 8 is a cross-sectional view of a regenerative combustion burner according to the second embodiment and the third embodiment of the present invention.
Figure 9:
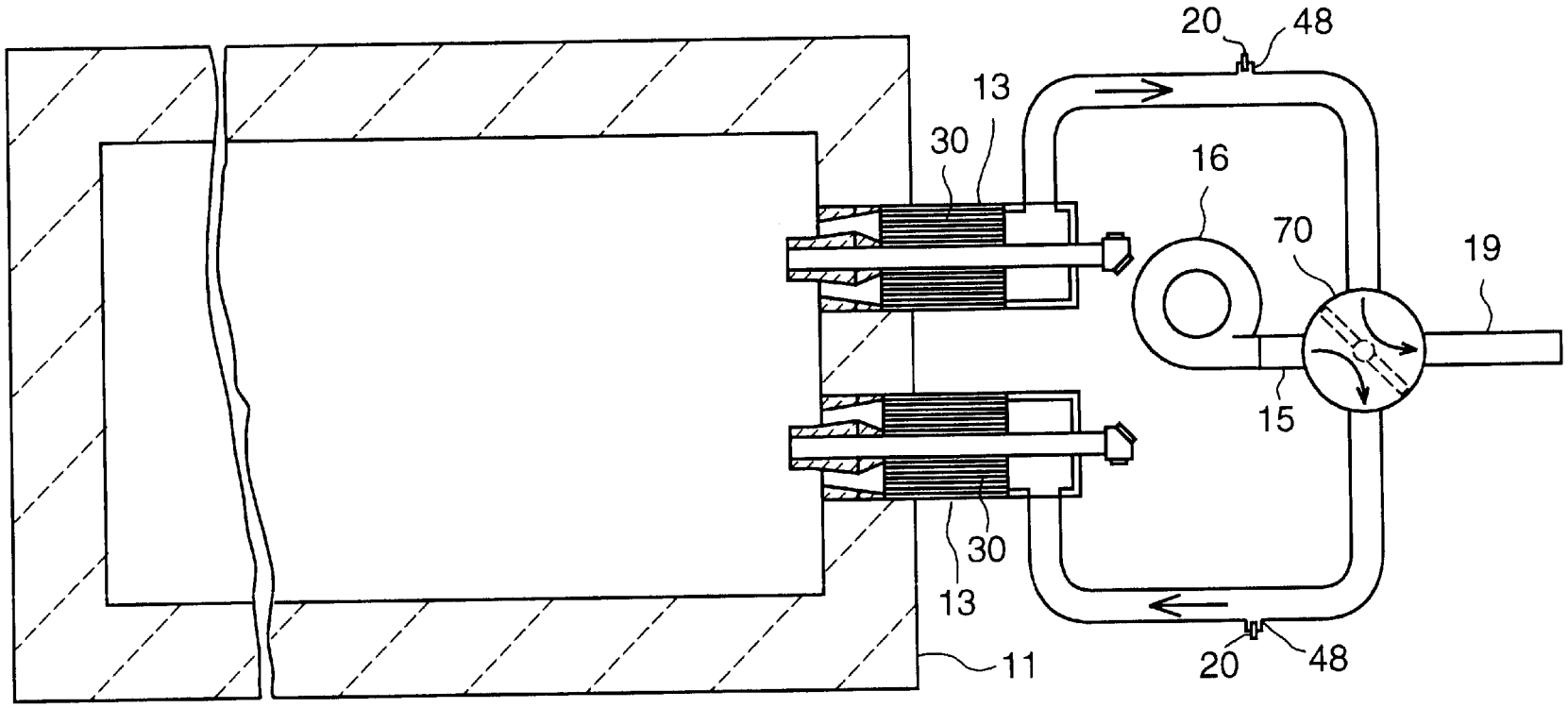
FIG. 9 is a schematic cross-sectional view of the apparatus having a twin burner system according to the second embodiment and the third embodiment of the present invention.

The regenerative combustion burner 13 may be a single burner having an air supply and gas exhaust switching mechanism 40 shown in FIG. 8 or a twin burner type shown in FIG. 9, whose switching between air supply and gas exhaust is conducted by a switching valve 70.

The single type regenerative combustion burner 13, as illustrated in FIG. 8, includes a casing 34, a heat storage member 30 (constructed from a honeycomb ceramic member or a bundle of metal or ceramic rods) which is divided into a plurality of sections each housed in a cylinder 31 disposed in the casing 34, a burner tile disposed on one axial side of the heat storage member 30, the air supply and gas exhaust switching mechanism 40 disposed on the other axial side of the heat storage member 30, and a fuel injection (or expelling) nozzle 60 extending through the heat storage member 30 and the mechanism 40 up to the burner tile 62.

The heat storage member 30 retrieves the heat of exhaust gas when exhaust gas passes through the heat storage member 30 and stores the heat therein. When the supply air passes through the heat storage member 30, the heat storage member 30 releases the storing heat to the supply air to pre-heat the supply air. The gas passable region of the heat storage member 30 is divided into a plurality of sections in a circumferential direction of the heat storage member 30. When exhaust gas flows through a portion of the gas passable region of the heat storage member 30, supply air flows through the remaining portion of the gas passable region of the heat storage member 30. Air supply and gas exhaust is switched by the switching mechanism 40. The burner has a pilot air supply tube 61.

The burner tile 62 is made from ceramic or heat-resistant material. The burner tile 62 includes an air supply and gas exhaust surface 63, air supply and gas exhaust holes 66 open to the surface 63, and a protrusion 64 protruding ahead from the surface 63. A fuel release surface 65 is formed at a portion of the protrusion from the inside surface of the protrusion 64 to a front end surface of the protrusion 64. The holes 66 are open at a portion of the surface 63 outside the protrusion 64. The holes 66 and the sections of the heat storage member correspond to each other in the circumferential direction of the burner. When exhaust gas flows through a portion of the holes 66, supply air flows through the remaining portion of the holes 66.

The air supply and gas exhaust switching mechanism 40 includes a rotatable member 44 and a fixed member 46, and the rotatable member 44 includes a dividing wall 41 for dividing a chamber through which supply air flows and a chamber through which exhaust gas flows. The fixed member 46 has a plurality of holes 47 corresponding to the sections of the heat storage member 30. The rotatable member 44 includes at least one opening 42 located on one side of the dividing wall 41 and at least one opening 43 located on the other side of the dividing wall 41. The opening 42 communicates with an air supply port 51 and the opening 43 communicates with an exhaust gas exit port 52. The rotatable member 44 is rotated by a drive device 45 (a motor or a cylinder) in one direction or opposite directions. Air supply and gas exhaust are switched by causing the hole 47 which had coincided with the opening 42 to coincide with the opening 43 and causing the hole 47 which had coincided with the opening 43 to coincide with the opening 42.

In the case where the regenerative combustion burner 13 is a single type burner, the oxygen sensor 20 is disposed between the heat storage member 30 and a sliding surface between the fixed member 46 and the rotatable member 44 of the switching mechanism 40. The fixed member 46 is thickened. A recess 48 is formed in the fixed member 46 and is defined by a hole extending through the fixed member 46 from an outside surface of the fixed member to the hole 47. The oxygen sensor 20 is disposed so that a detecting portion of the oxygen sensor is located in the recess 48. Since the oxygen sensor 20 is located downstream of the heat storage member 30 in the exhaust gas flow direction, the temperature of the exhaust gas is lowered to about 300° C. and the durability of the oxygen sensor 20 is improved. Further, since the oxygen sensor 20 is located downstream of the sliding surface between the fixed member 46 and the rotatable member 44 of the switching mechanism 40, even if a small leakage of supply air to exhaust gas occurs at the sliding surface, the oxygen sensor 20 is not affected by the leakage and a true oxygen concentration of the exhaust gas can be detected. Therefore, a highly accurate detection of the oxygen concentration is conducted and a highly reliable control of the air ratio is possible.

As illustrated in FIG. 9, the regenerative combustion burner 13 may be a burner used for a twin burner system. In this type of system, switching between air supply and gas exhaust is conducted by a switching valve 70 (for example, a four port valve) which is provided in an air supply and gas exhaust passage 15, 19 connected to the burners 13. Therefore, the switching mechanism 40 of the single type of burner is not provided in this system. The heat storage member 30 of this type of burner does not need to be divided into a plurality of sections in the circumferential direction of the burner. The other structures of this type of burner including the burner tile and the fuel injection nozzle are the same as those of the single burner.

As illustrated in FIG. 9, the oxygen sensor 20 is disposed in a portion of the air supply and gas exhaust passage 15, 19 located between the heat storage member 30 and the switching valve 70. Due to this, the same effect and advantages (the sensor is exposed to exhaust gas at a low temperature and is not affected by gas leakage between supply air and exhaust gas) as those of the single burner are obtained.

Preferably, as illustrated in FIGS. 10–13, the recess 48 is formed to the air supply and gas exhaust passage 15, 19, and the detecting portion 20*a* of the oxygen sensor 20 is disposed in the recess 48.

Figure 10:
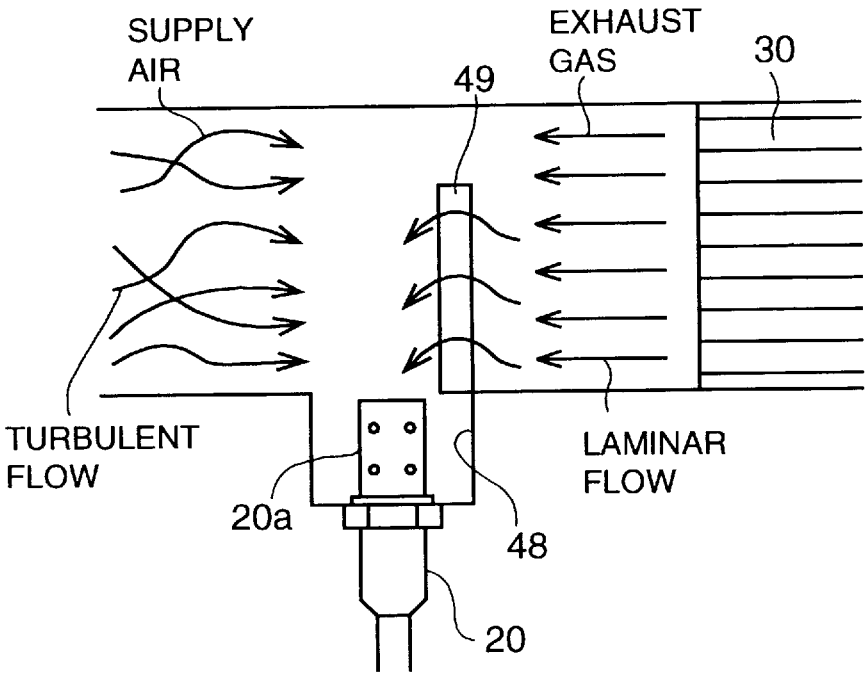
FIG. 10 is a cross-sectional view of a portion of the regenerative combustion apparatus close to the oxygen sensor according to the second embodiment of the present invention.
Figure 11:
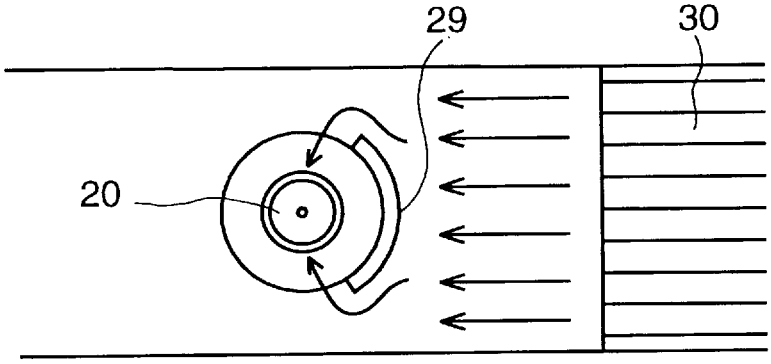
FIG. 11 is a plan view of the portion of FIG. 10.

Preferably, as illustrated in FIGS. 10 and 11, in a case where the heat storage member 30 of the regenerative combustion burner 13 has a flow straightening function, a flow disturbing member 49 is provided in the vicinity of the recess 48 in which the oxygen sensor 20 is disposed. The flow disturbing sensor 49 is disposed at an upstream of the oxygen sensor 20 in the exhaust gas flow direction. The flow disturbing member 49 disturbs the exhaust gas flow flowing from the heat storage member 30.

The reason why it is preferable to provide such a flow disturbing member 49 will be explained below.

In a case where the detecting portion 20*a* of the oxygen sensor 20 protrudes into the exhaust gas flow and supply air flow, since the sensor 20 picks up a deviation of the oxygen concentration of the exhaust gas, the output electrical current of the oxygen sensor finely vibrates and the stability is decreased. While supply air is flowing, a large amount of air hits the sensor 20 thereby lowering the temperature of the sensor 20. To prevent the temperature of the sensor from excessively lowering, the electrical voltage imposed on the heater of the sensor has to be high.

By locating the sensor 20 in the recess 48, the too keen response of the oxygen sensor and the excessive lowering of the temperature of the sensor are prevented.

In the case where the detecting portion 20*a* of the sensor 20 is positioned within the recess 48, supply air which is turbulent easily flows into the recess 48. However, since the exhaust gas flowing from the heat storage member 30 is laminar and it is a directed flow, little exhaust gas flows into the recess 48 and it cannot perfectly purge the supply air which is stagnant in the recess 48 when the flow disturbing member 49 is not provided. As a result, the output electrical current of the oxygen sensor 20 will be greater than the electrical current corresponding to the true oxygen concentration, and therefore, the amount of supply air will be controlled such that it is less than the true amount in the air ratio control, consequently, imperfect combustion will occur. To prevent this, by providing the flow disturbing member 49, the exhaust gas flowing from the heat storage member 30 hits the flow disturbing member 49 to cause turbulent flow which can easily enter the recess 48 thereby purging the air which otherwise would be stagnant in the recess. As a result, the oxygen sensor 20 issues an output electrical current which accurately corresponds to the true oxygen concentration.

Figure 12:
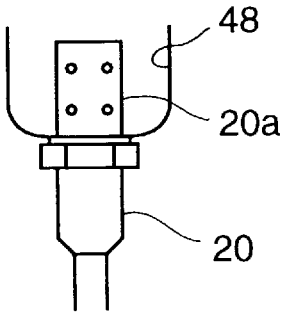
FIG. 12 is a cross-sectional view of a portion of the regenerative combustion apparatus having a recess, a bottom surface of which is curved.
Figure 13:
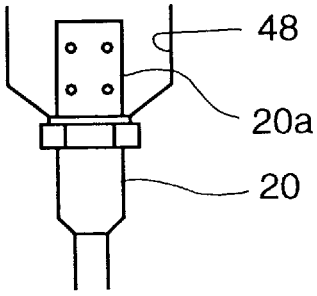
FIG. 13 is a cross-sectional view of the portion of the regenerative combustion apparatus having a recess, a bottom surface of which is tapered.

The bottom surface of the recess 48 may be curved or tapered as illustrated in FIGS. 12 and 13, respectively, to obtain a smooth purging, as well as flat.

The structure of the oxygen sensor 20 is the same as that discussed in the first embodiment of the present invention.

The principle as to detecting the oxygen concentration of the oxygen sensor is the same as that discussed in the first embodiment of the present invention using FIGS. 3–6.

As discussed in the first embodiment of the present invention, the output characteristic of the oxygen sensor 20 of FIG. 2 is shown in FIG. 3. FIG. 4 illustrates the output electrical current characteristic of the oxygen sensor at the temperature of 700° C. and at the imposed electrical voltage of 0.7 V. The characteristic is substantially linear at the air rich environment.

As discussed in the first embodiment of the present invention, by conducting a feed back control using the oxygen sensor 20, combustion at a low oxygen concentration is possible.

A combustion control method conducted using the above-describe apparatus includes the steps of (a) detecting the oxygen concentration based on the output electrical current signal issued from the oxygen sensor 20 which is provided in the regenerative combustion burner 13 or the air supply or gas exhaust passages 15, 19 thereof, and (b) controlling an air ratio based on the detected electrical current signal.

As discussed in the first embodiment of the present invention, an automobile lean mixture sensor can be used for the oxygen sensor 20.

The example of combustion of HI-LO-OFF discussed in the first embodiment of the present invention is also applicable to the second embodiment of the present invention. By this combustion control, both combustion at a low oxygen concentration and suppression of the exhaust of carbon monoxide to the atmosphere are achieved. Further, suppression of NOx generation, a high thermal efficiency (because the amount of excess air is small and the energy exhausted together with the exhaust gas is small), and heating accompanied by no oxidation are achieved.

FIG. 7 illustrates a combustion control device which can self-inspect degradation of the oxygen sensor 20 and trouble which occurs in the combustion apparatus. This device is installed in the control box 18 (computer).

The device and method of FIG. 7 are the same as those discussed in the first embodiment of the present invention. By providing such a self-inspecting device and method, reliability of the combustion method and apparatus according to the second embodiment of the present invention is improved. Further, even if some trouble happens, it is possible to know where the trouble happens, and optimum measures can be taken. The self-inspection can be conducted even during operation of the furnace.

The following technical advantages are obtained according to the second embodiment of the present invention:

Since the oxygen sensor is provided in the burner or the air supply and gas exhaust passages thereof and an air ratio is controlled based on the output electrical current of the oxygen sensor, the air ratio is stabilized.

In the case where the oxygen sensor is disposed downstream of the heat storage member in the exhaust gas direction, the temperature of the environment of the oxygen sensor is relatively low and the life of the sensor is lengthened. In the case where the oxygen sensor is disposed downstream of the air supply and gas exhaust switching mechanism in the supply air flow direction, the oxygen sensor is not affected by leakage which may occurs in the switching mechanism. As a result, the control is reliable.

In the case where an automobile oxygen sensor is used for the oxygen sensor, decrease in cost, compact size and high response are achieved.

In the case where the regenerative combustion apparatus is provided with the self-inspecting device, degradation of the sensor, blockade of the heat storage member, leakage at the switching mechanism and trouble which occurs in the blower will be detected.

In the case where the oxygen sensor is located in the recess, while supply air flows, the oxygen sensor is prevented from being exposed to the flow of a too large amount of supply air so that the temperature of the oxygen sensor is prevented from lowering to a great extent. Further, while exhaust gas flows, the oxygen sensor is prevented from too keenly responding to the deviation of the oxygen concentration of the exhaust gas so that the output electrical current of the oxygen sensor is stabilized.

In the case where the flow disturbing member is provided in the vicinity of the oxygen sensor, the laminar flow of exhaust is disturbed and can flow into the recess thereby purging the air that is stagnant in the recess. As a result, the output electrical current issued from the oxygen sensor is very close to a current corresponding to the true oxygen concentration of the exhaust gas.

THIRD EMBODIMENT

A combustion control method and apparatus according to the third embodiment of the present invention will be explained with reference to FIGS. 1A and 1B, FIG. 6. FIGS. 8 and 9, and FIGS. 14–19.

With the oxygen sensor having the zirconia solid electrolyte used in the method and apparatus according to the first and second embodiment of the present invention, a constant electrical voltage is imposed on the oxygen sensor. It has been found by the inventors of this patent application that the output electrical current of the oxygen sensor varies according to the amount of unburnt components included in exhaust gas when the electrical voltage imposed on the oxygen sensor is equal to or near 0 V. In the third embodiment of the present invention, this phenomenon is utilized for detecting the unburnt components in the exhaust gas.

The principle of detecting the oxygen concentration when an electrical voltage for controlling the air ratio is imposed on the oxygen sensor and the principle of monitoring unburnt components when an electrical voltage for monitoring the unburnt components (about 0 V) is imposed on the oxygen sensor will be explained below.

First, the former principle of detecting the oxygen concentration will be explained with reference to FIGS. 14 and 15 and FIG. 6 (common with the first and second embodiments of the present invention).

Figure 14:
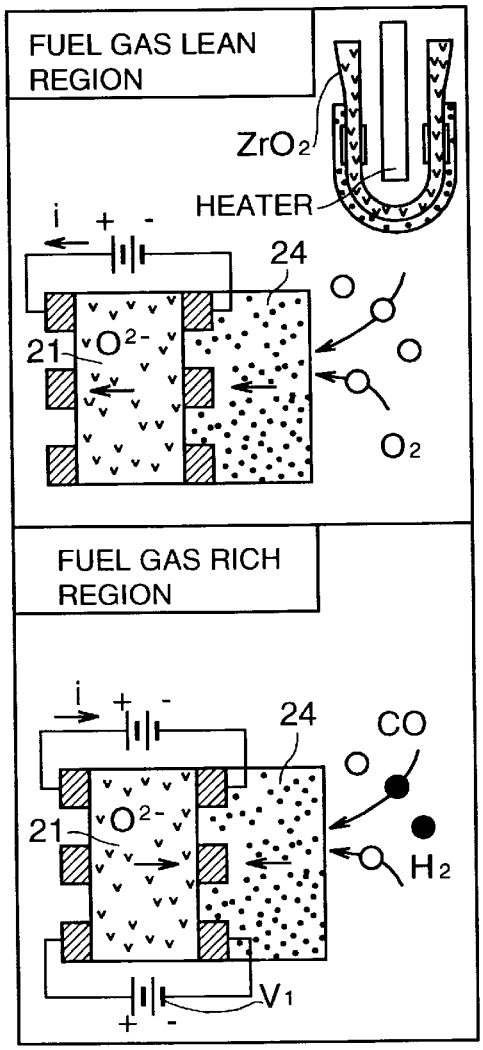
FIG. 14 is a cross-sectional view of a portion of the oxygen sensor used in the method and apparatus according to the third embodiment of the present invention illustrating a flow of an oxygen ion in a fuel rich condition and in a fuel lean condition.

When an electrical current flows in the zirconia solid electrolyte 21 in a gas lean range and at a temperature above the predetermined temperature (for example, 650° C.), as illustrated in the upper half portion of FIG. 14, oxygen ions ($O^{2-}$) move in the solid electrolyte 21 from the cathode to the anode. This movement of oxygen ions is detected as an electric current by an electrical current detector 3, and the electrical current increases in proportion to an increase in the imposed electrical voltage. When a diffusion control layer 24 is provided on the cathode side, the output electrical current saturates to be constant even if the imposed electrical voltage is increased as illustrated in the left half portion of FIG. 6. In this range where the output electrical current is saturated, at a constant imposed electrical voltage ($V_0$, for example, 0.7 V), there is a linear relationship between the oxygen concentration and the saturated output electrical current as illustrated in the right half portion of FIG. 6.

Therefore, at the constant imposed electrical voltage, if the output electrical current of the oxygen sensor is controlled to be a predetermined electrical current value, the oxygen concentration included in the exhaust gas can be controlled to a predetermined oxygen concentration value. Utilizing this characteristic of the oxygen sensor, the air ratio can be controlled. In the air ratio control, it is important to impose the predetermined electrical voltage to the oxygen sensor and to utilize the saturated output electrical current range.

Second, the latter principle of monitoring the unburnt components included in the exhaust gas will be explained.

In the gas (fuel) rich range, as illustrated in the lower half portion of FIG. 14, there are no oxygen molecules in the exhaust gas, and unburnt components such as hydrocarbons (HC), hydrogen ($H_2$) and carbon monoxide (CO) are included in the exhaust gas. When the same test as in the case of the gas lean conditions is conducted, movement of oxygen ions from the anode to the cathode occurs whereby an electromotive force V1 is caused. This movement of the oxygen ions is caused in a direction opposed to the direction of the movement of the oxygen ions caused in the gas lean conditions. Therefore, when V1 is greater than V (V is the electrical voltage imposed on the oxygen sensor), the direction of the electrical current i is a reversed one. This reversed electrical current appears in an electrical current negative region in the graph of electrical current i versus imposed electrical voltage V of FIG. 15, as shown by the curves at air-fuel ratios 14 and 12.

The case of combustion using a burner (hereinafter, burner combustion) is different from the cases of the above-described gas lean condition and the gas rich condition. Because the burner combustion is conducted at an air ratio greater than 1 (where the air ratio of 1 corresponds to perfect combustion), in the exhaust gas of the burner combustion not only oxygen but also the unburnt components such as hydrocarbons, hydrogen and carbon monoxide are contained. Therefore, the condition of combustion corresponds to a condition where oxygen ($O_2$) is further added to the condition of the lower half portion of FIG. 14. It was found by the inventors of the present invention that when the same test as that in the case of the gas lean condition (where unburnt components such as hydrocarbons are not included) was conducted with the burner combustion case, in FIG. 15, the i versus V characteristics illustrated by one-dotted lines, which are shifted from the full line characteristics to a downward direction by a certain amount δ, appeared. This amount of δ is generated by the unburnt components. The greater the amount of the unburnt components, the greater the amount δ.

However, in the above-described characteristic shown by the one-dotted lines, it is difficult to know whether the amount δ generated at the constant imposed electrical voltage (for example, 0.7 V) is caused due to a decrease in the air-fuel ratio or due to the unburnt components contained in the exhaust gas. Therefore, the conventional i versus V characteristic made at the constant imposed electrical voltage cannot be used for detecting and controlling the unburnt components.

Figure 15:
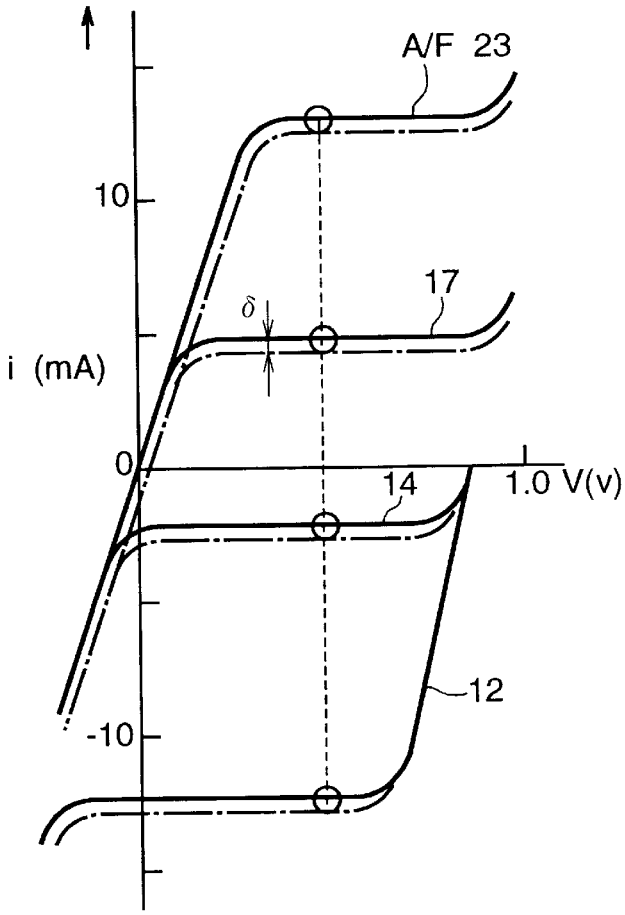
FIG. 15 is a graph illustrating a relationship between an imposed electrical voltage (V) and an output electrical current (i) of the oxygen sensor used in the method and apparatus according to the third embodiment of the present invention.

However, it was found by the inventors of the present invention that if the imposed electrical voltage was equal to or near 0, the i versus V characteristic could be used for detecting or monitoring the amount of the unburnt components included in the exhaust gas. The reason is as follows:

In FIG. 15, in the range where the oxygen exists in the exhaust gas (the range is substantially equal to a range where the electrical current i is positive), even if the air-fuel ratio A/F varies, the i versus V characteristics become a single line in the range close to 0 V and necessarily pass through the origin of the graph. This means that the i versus V characteristic is not affected by the air-fuel ratio (namely is not affected by whether or not the oxygen is included in the exhaust gas), when the imposed electrical voltage is equal to or near 0 V. Further, it is recognized that, in the range where the imposed electrical voltage is equal to or near 0, a decrease in the i versus V characteristic remains and the decrease amount δ has a relationship with the amount of the unburnt components contained in the exhaust gas. Therefore, by switching the imposed electrical voltage of the oxygen sensor to 0 or near 0 and measuring the output electrical current of the oxygen sensor, it is possible to detect or monitor the amount of the unburnt components included in the exhaust gas without being affected by the air-fuel ratio and the air ratio. The present invention was made based on the above-described discovery.

The combustion control method and apparatus for a burner according to the third embodiment of the present invention will now be explained with reference to FIGS. 1A, 1B, 6, 8, 9, and 14–19. The oxygen sensor used in the method and apparatus according to the third embodiment of the present invention has the same structure as that of an automobile lean mixture sensor. However, the air-fuel or air ratio control system according to the third embodiment of the present invention differs from the system connected to the automobile lean mixture sensor in the points (a) that the imposed electrical voltage can be switched between the voltage for the air ratio control and the voltage for monitoring the unburnt components so that the single sensor can be used for both controlling the air ratio and monitoring the unburnt components, (b) that the control box for controlling the switching is provided, and (c) that revival of the oxygen sensor from a degraded condition is possible.

Figure 16:
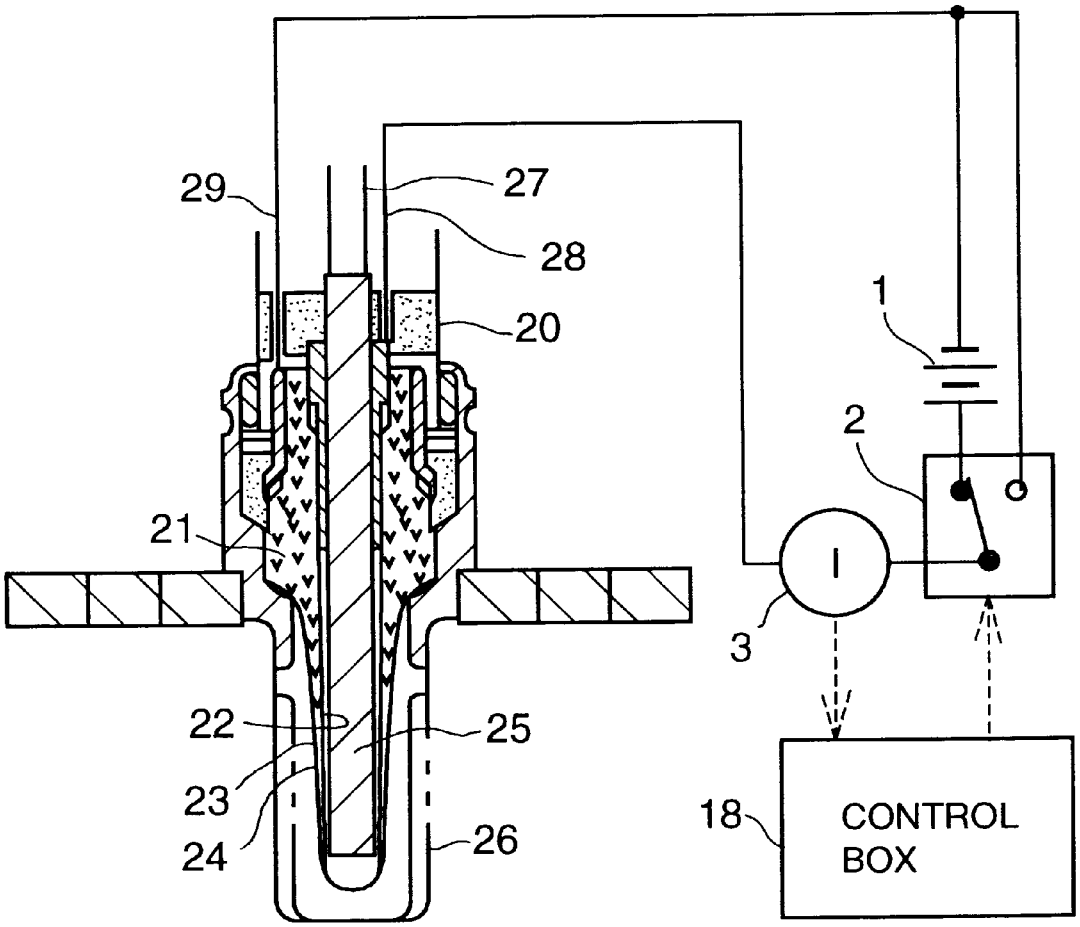
FIG. 16 is a cross-sectional view accompanied by an electrical circuit of the oxygen sensor used in the method and apparatus according to the third embodiment of the present invention.

As illustrated in FIG. 16, the combustion control apparatus for a burner according to the third embodiment of the present invention includes (a) the oxygen sensor 20 including the solid electrolyte 21, (b) an imposed electrical voltage switching device 2 constructed and arranged to switch the electrical voltage imposed on the oxygen sensor 20 between a first electrical voltage controlling an air ratio and a second electrical voltage (equal to or near 0 V) used when inspecting unburnt components, and (c) a monitoring device constructed and arranged to monitor the concentration of the unburnt components included in exhaust gas according to the magnitude of the negative output electrical voltage of the oxygen sensor when the electrical voltage imposed on the oxygen sensor at the second electrical voltage for monitoring the unburnt components. The monitoring device is a device for conducting step 112 of the control routine of FIG. 17 which is stored in the control box 18.

The combustion control apparatus according to the third embodiment of the present invention further includes an air ratio control device constructed and arranged to conduct an air ratio control when the electrical voltage imposed on the oxygen sensor 20 is at the first electrical voltage. The air ratio control device is a device for conducting step 113 of the control routine of FIG. 17 which is stored in the control box 18.

The combustion control apparatus according to the third embodiment of the present invention further includes an oxygen sensor reviving device constructed and arranged to determine whether the oxygen sensor 20 is in an abnormal condition and to revive the oxygen sensor 20 when it is determined that the oxygen sensor 20 is in the abnormal condition. The oxygen sensor reviving device is a device for conducting the control routine of FIG. 18 which is stored in the control box 18.

As illustrated in FIG. 16, the oxygen sensor 20 includes the zirconia solid electrolyte 21, the platinum electrodes 22 and 23, diffusion control layer 24. The oxygen sensor 20 further includes a heater 25 (for example, a ceramic heater) for heating the temperature of the portions 21, 22, 23 and 24 of the oxygen sensor 20 to a temperature above about 650° C., a protecting cover 26 and a lead 27 for the heater.

The inside electrode 22 and the outside electrode 23 are connected via leads 28 and 29 to a power source 1 for imposing an electrical voltage on the oxygen sensor. The connection can be switched by the electrical voltage switching device 2 so that the electrical voltage imposed on the oxygen sensor 20 is switched between the first electrical voltage (for example, 0.6–0.7 V) and the second electrical voltage (equal to or near 0 V). The switching is conducted according to the instruction signal from the control box 18, or manually. In a portion of the electrical circuit connecting the inside and outside electrodes 22 and 23 and the power source 1, an electrical current detecting device 3 for detecting the output electrical current of the oxygen sensor 20 and feeding the detected electrical current to the control box 18 is provided.

Figure 17:
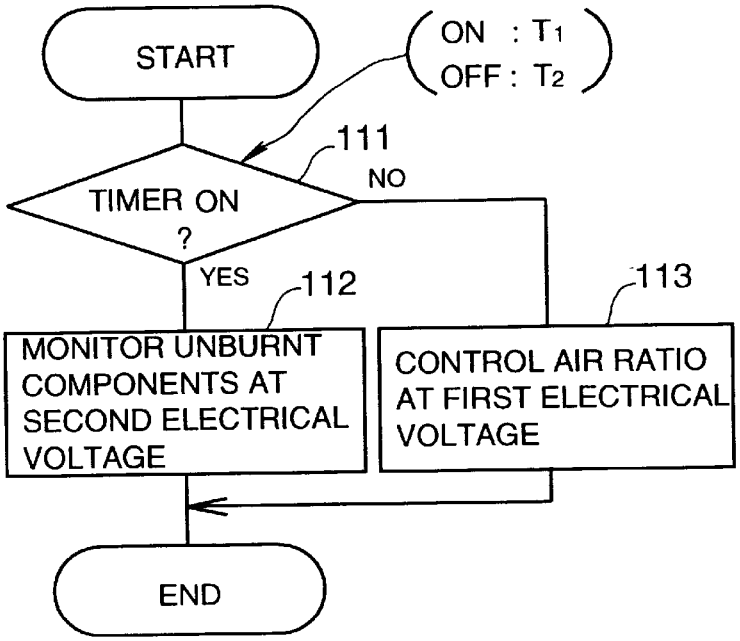
FIG. 17 is a flow chart of a control routine for controlling an air ratio and monitoring unburnt components in the method and apparatus according to the third embodiment of the present invention.
Figure 18:
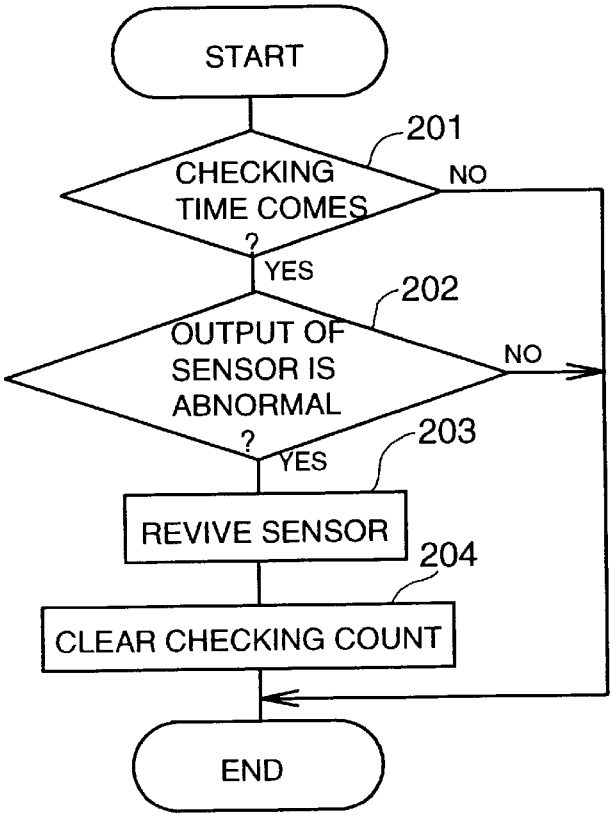
FIG. 18 is a flow chart of a control routine for reviving the oxygen sensor in the method and apparatus according to the third embodiment of the present invention.

The control routine of FIG. 17 and the control routine of FIG. 18 are stored in the control box 18.

When burner combustion begins, the routine of FIG. 17 is entered at intervals of a predetermined time period. At step 111, a decision is made as to whether the timer issues an ON or OFF signal. The timer is a timer of the type that issues an ON signal for a time period of $T_1$ and an OFF signal for a time period of $T_2$ alternately. When it is determined at step 111 that the timer issues an ON signal, the routine proceeds to step 112 where the electrical voltage imposed on the oxygen sensor 20 is switched to an electrical voltage equal to or near 0 V and monitoring the unburnt components is conducted. When it is determined at step 111 that the timer issues an OFF signal, the routine proceeds to step 113 where the electrical voltage imposed on the oxygen sensor 20 is switched to about 0.7 V and control of the air ratio is conducted. The routine proceeds from steps 112 and 113 to the END step. Due to this control routine, the air ratio control and the monitoring of the unburnt components are repeated, alternately.

When the burner combustion begins, the control routine of FIG. 18 is entered at intervals of a predetermined time period. At step 201, a decision is made as to whether the time counted by a time counter reaches a time when monitoring should be conducted (hereinafter, a monitoring conducting time). When it is determined that the counted time does not reach the monitoring conducting time, the routine proceeds to the END step, and when it is determined that the counted time reaches the monitoring conducting time, the routine proceeds to step 202. At step 202, a decision is made as to whether an abnormal output is seen in the output electrical current of the oxygen sensor 20. For example, when fuel gas is cut and only air flows to the burner, the concentration of oxygen in the exhaust gas is 21%. It is checked whether the oxygen sensor issues the reference oxygen concentration of 21%, and when the output electrical current of the oxygen sensor 20 does not coincide with the reference oxygen concentration, it is determined that something abnormal has happened to the oxygen sensor. If nothing abnormal has happened, the routine proceeds to the END step, and if anything abnormal has happened, the routine proceeds to step 203. For example, when some organic material has adhered to the surface of the oxygen sensor, the output electrical current of the oxygen sensor will be lowered, and in such a case, it will be determined that something abnormal has happened.

At step 203, revival of the oxygen sensor 20 is conducted. The revival is conducted by supplying clean air to the oxygen sensor 20 and heating the oxygen sensor 20 by the ceramic heater 25 thereby burning the organic material adhering to the surface of the oxygen sensor 20. In the case of the regenerative combustion burner, a supply air can be used for the clean air. Other methods are forced air blown against the sensor, or taking the sensor from the flue and then exposing it to the atmosphere. When the organic material has been burned, the oxygen sensor 20 is in a revived state which is substantially the same as the initial state. Then, the routine proceeds to step 204, where the time counter is cleared (the counted time is cleared to 0). Then, the time begins to be counted for the next revival of the oxygen sensor.

Next, a combustion control method according to the third embodiment of the present invention will be explained.

A combustion control method for a burner according to the third embodiment of the present invention includes the steps of: controlling an imposed electrical voltage of the oxygen sensor 20 having the solid electrolyte to an electrical voltage equal to or near 0; and monitoring a concentration of unburnt components included in exhaust gas of burner combustion based on an output electrical current of the oxygen sensor 20.

The combustion control method according to the third embodiment of the present invention further includes the steps of: switching the imposed electrical voltage of the oxygen sensor 20 between the first electrical voltage used when controlling an air ratio and the second electrical voltage equal to or near 0 used when monitoring the concentration of unburnt components; and controlling the air ratio while the electrical voltage is at the first electrical voltage and monitoring the concentration of unburnt components while the electrical voltage is at the second electrical voltage.

The combustion control method according to the third embodiment of the present invention further includes the step of burning an organic substance, which has been generated due to combustion and has adhered to the surface of the oxygen sensor 20, by the electrical heater 25 of the oxygen sensor under a clean condition. In this instance, the clean condition means that the environment in the vicinity of the oxygen sensor 20 includes no or little exhaust gas.

Figure 19:
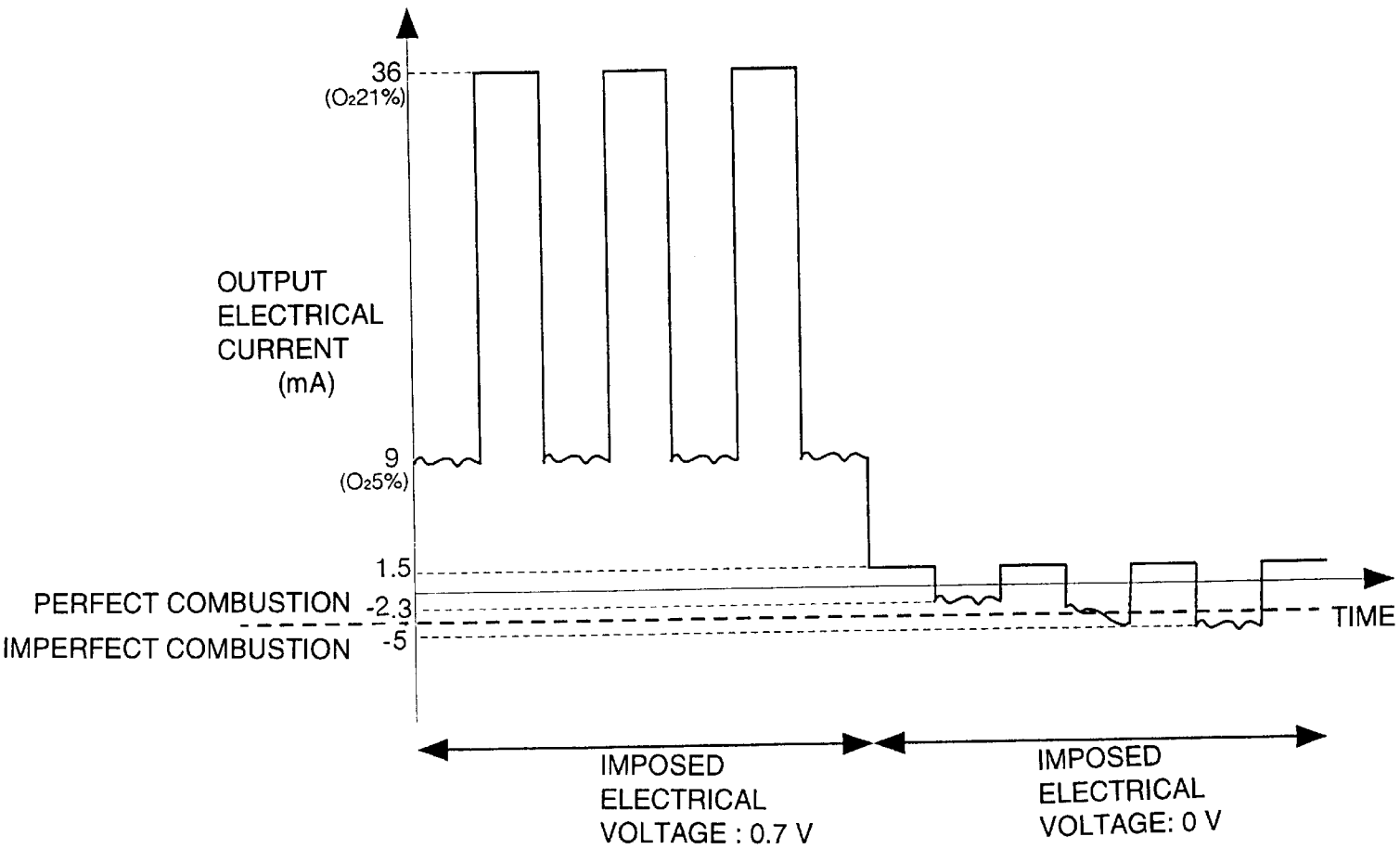
FIG. 19 is a graph illustrating a relationship between an output electrical current and a time elapsed when combustion is controlled according to the method and apparatus according to the third embodiment of the present invention.

FIG. 19 illustrates the change in the output electrical current of the oxygen sensor 20 mounted to the single-type regenerative combustion burner when the cycle of conducting an air ratio control and then monitoring unburnt components was conducted. In the test, the imposed electrical voltage during the air ratio control was 0.7 V, and the imposed electrical voltage while monitoring unburnt components was 0 V. In FIG. 19, at the imposed electrical voltage of 0.7 V, the condition of the output electrical current of 9 mA corresponds to an exhaust condition, and the condition of the output electrical current of 36 mA corresponds to an air supply condition. Due to switching between air supply and gas exhaust, the output electrical current changed in the form of pulses. In the case where the imposed electrical voltage was 0 V, the same characteristic was obtained.

When the imposed electrical voltage was cut or switched to 0 V, in the case of perfect combustion, the output electrical current of the oxygen sensor was −2.3 mA, while in the case of imperfect combustion where carbon monoxide and hydrocarbons are included in the exhaust gas, the output electrical current of the oxygen sensor lowered. When the decrease amount of the output electrical current exceeds the allowable limit (a value shown by a dotted line in FIG. 19) and comes to the portion lower than the dotted line in the graph of FIG. 19, the control box 18 takes at least one of (1) issuing an alarm, (2) increasing the supply air amount, and (3) throttling the fuel supply amount or cutting supply of the fuel.

FIGS. 1B, 8, 9, and 1A illustrate a plurality of types of furnaces to which the combustion control method and apparatus according to the third embodiment of the present invention are applied.

More particularly, FIG. 1B and FIG. 8 illustrate a furnace 11 to which the single-type regenerative combustion burner 13 is installed. In the burner, the oxygen sensor 20 is disposed between the heat storage member 30 and the air supply and gas exhaust switching mechanism 40. The structure of the furnace 11, the structure of the regenerative combustion burner 13, and the control thereof are the same as those discussed in the explanation of the second embodiment of the present invention.

The output of the oxygen sensor 20 is fed to the control box 18. When the imposed electrical voltage is ON, a necessary amount of supply air corresponding to the amount of fuel is calculated based on the output electrical voltage of the oxygen sensor 20 in the control box 18, and the calculated supply air amount signal is fed to the control motor thereby controlling the opening degree of the control valve 17.

By switching the electrical voltage imposed on the oxygen sensor 20 to an electrical voltage equal to or near 0 V and monitoring the output electrical current of the oxygen sensor 20, reliable inspection and control of unburnt components are conducted.

FIG. 9 illustrates a furnace 11 to which a pair of regenerative combustion burners are installed, and the structure thereof is the same as that discussed in the explanation of the second embodiment of the present invention.

In the twin burner system, the oxygen sensor 20 is disposed at a portion of the air supply and gas exhaust passages 15 and 19 between the heat storage member 30 and the switching valve 70 which is an air supply and gas exhaust switching mechanism. Due to this, like the case of the single-type burner, durability of the oxygen sensor is improved because of the low temperature and the output of the oxygen sensor is not affected from leakage which may occur at the switching valve 70. Further, by switching the electrical voltage imposed on the oxygen sensor 20 to an electrical voltage equal to or near 0 V and monitoring the output electrical current of the oxygen sensor 20, reliable detection and control of unburnt components are conducted.

FIG. 1B illustrates a furnace 11 to which a usual type burner 13 (not a regenerative combustion type burner) is installed. The structure of the furnace and the control system is the same as that discussed in the explanation of the first embodiment of the present invention.

The output electrical current of the oxygen sensor 20 is fed to the control box 18. When the imposed electrical voltage is ON, a necessary amount of supply air corresponding to the amount of fuel is calculated based on the output electrical voltage of the oxygen sensor 20 in the control box 18, and the calculated supply air amount signal is fed to the control motor thereby controlling the opening degree of the control valve 17.

By switching the electrical voltage imposed on the oxygen sensor 20 to an electrical voltage equal to or near 0 V and monitoring the output electrical current of the oxygen sensor 20, reliable inspection and control of unburnt components are conducted.

According to the third embodiment of the present invention, the following technical advantages are obtained.

Since the electrical voltage imposed on the oxygen sensor is switched to 0 V or near 0 V and the concentration of unburnt components included in exhaust gas is monitored and detected based on the output electrical current, the monitoring is not affected by the value of the air ratio so that the concentration of the unburnt components included in the exhaust gas can be reliably monitored and reliable combustion is conducted.

In the case where the imposed electrical voltage can be switched between the first electrical voltage and the second electrical voltage, using the single oxygen sensor for both controlling the air ratio and monitoring the unburnt components can be conducted.

In the case where some organic material which has adhered to the oxygen sensor is burned by the heater of the oxygen sensor, the oxygen sensor can be revived to a substantially initial state and reliable combustion control is possible.

Although embodiments of the present invention were described in which the air amount was controlled according to the output of the oxygen sensor, the fuel amount may be controlled or both the air amount and the fuel amount may be controlled. Therefore, an increase in the air ratio means any one of an increase in the supply air amount, a decrease in the fuel amount, and simultaneous execution of increasing the supply air amount and decreasing the fuel amount.

Although the present invention has been described with reference to specific exemplary embodiments, it will be appreciated in the art that various modifications and alterations can be made to the particular embodiments shown, without materially departing from the novel teachings and advantages of the present invention. Accordingly, it is to be understood that all such modifications and alterations are included within the spirit and scope of the present invention as defined by the following claims.

What is claimed is:

1. A combustion control method for controlling combustion conducted using a combustion apparatus in which fuel and air are supplied to conduct combustion, said method comprising:

providing an oxygen sensor for detecting an oxygen concentration by an electric current generated in said oxygen sensor in one of a furnace and a flue of said furnace;

detecting the oxygen concentration of the gas in said one of said furnace and said flue by the electric current signal generated from said oxygen sensor;

automatically controlling an air/fuel ratio based on the detected oxygen concentration, and during said controlling of said air/fuel ratio, automatically inspecting for degraded performance of said oxygen sensor and for a problem with said combustion apparatus, said problem including a blockage of a heat storage member, or leakage of a switching mechanism, said inspecting including:

determining whether combustion is OFF, determining whether an output electric current of said oxygen sensor is greater than a predetermined value B when it is determined that combustion is not OFF, instructing a decrease of said air ratio when it is determined that the output electric current of said oxygen sensor is greater than the predetermined value B, instructing an increase of said air ratio when it is determined that the output electric current of said oxygen sensor is equal to or less than the predetermined value B, determining whether the output electric current of said oxygen sensor is equal to or less than a predetermined value C which is smaller than said predetermined value B after said instructing an increase, instructing a system shutdown when it is determined that the output electric current of said oxygen sensor is equal to or less than the predetermined value C, determining whether the output electric current of said oxygen sensor is greater than a predetermined value A which is greater than said predetermined value B when it is determined that combustion is OFF, instructing continuance of operation when it is determined that the output electric current of said oxygen sensor is greater than the predetermined value A, and expressing that said oxygen sensor has degraded and instructing a necessary system shutdown when it is determined that the output electric current of said oxygen sensor is equal to or less than the predetermined value A.

2. A combustion control method for a burner using an oxygen sensor comprising the:

controlling an imposed electrical voltage of said oxygen sensor which includes a solid electrolyte to an electrical voltage equal to or near 0 volts; and monitoring a concentration of unburnt components included in exhaust gas of burner combustion based on an output electrical current of said oxygen sensor.

3. A combustion control method according to claim 2, further comprising the:

switching the imposed electrical voltage of said oxygen sensor between a first electrical voltage used when controlling an air ratio and a second electrical voltage equal to or near 0 volts used when monitoring the concentration of unburnt components; and controlling the air ratio while the electrical voltage is at said first electrical voltage and monitoring the concentration of unburnt components while the electrical voltage is at said second electrical voltage.

4. A combustion control method according to claim 2, further comprising the:

burning an organic combustion residue adhering to said oxygen sensor, by an electrical heater of said oxygen sensor under a clean condition, wherein said combustion residue caused said output electrical current to vary from an initial value.

5. A combustion control method according to claim 3, further comprising the:

burning an organic combustion residue adhering to said oxygen sensor, by an electrical heater of said oxygen sensor under a clean condition, wherein said combustion residue caused said output electrical current to vary from an initial value.

6. A combustion control apparatus for a regenerative combustion apparatus comprising:

a regenerative combustion burner including a heat storage member therein;

air supply and gas exhaust passages connected to said regenerative combustion burner; and an oxygen sensor disposed in one of said regenerative combustion burner and said air supply and gas exhaust passages, wherein said oxygen sensor is disposed in said regenerative combustion burner downstream of said storage member as viewed in an exhaust gas flow direction.

7. A combustion control apparatus according to claim 6, wherein said regenerative combustion burner includes an air supply and gas exhaust switching mechanism, and said oxygen sensor is disposed between said heat storage member and said air supply and gas exhaust switching mechanism.

8. A combustion control apparatus according to claim 6, wherein said oxygen sensor detects an oxygen concentration based on an electric current.

9. A combustion control apparatus according to claim 6, further comprising a device for inspecting degraded performance of said oxygen sensor and a problem with said combustion apparatus.

10. A combustion control apparatus according to claim 9, wherein said device includes:

a first portion constructed and arranged to determine whether combustion is OFF;

a second portion constructed and arranged to determine whether an output electric current of said oxygen sensor is greater than a predetermined value B when said first portion determines that combustion is not OFF;

a third portion constructed and arranged to instruct a decrease of an air ratio when said second portion determines that the output electric current of said oxygen sensor is greater than the predetermined value B;

a fourth portion constructed and arranged to instruct an increase of the air ratio when said second portion determines that the output electric current of said oxygen sensor is equal to or less than the predetermined value B;

a fifth portion constructed and arranged to determine whether the output electric current of said oxygen sensor is equal to or less than a predetermined value C which is smaller than said predetermined value B after said fourth portion instructs;

a sixth portion constructed and arranged to instruct a system shutdown when said fifth portion determines that the output electric current of said oxygen sensor is equal to or less than the predetermined value C;

a seventh portion constructed and arranged to determine whether the output electric current of said oxygen sensor is greater than a predetermined value A which is greater than said predetermined value B when said first portion determines that combustion is OFF;

an eighth portion constructed and arranged to instruct a continuance of operation when said seventh portion determines that the output electric current of said oxygen sensor is greater than the predetermined value A; and a ninth portion constructed and arranged to express that said oxygen sensor has degraded and to instruct a necessary system shutdown when said seventh portion determines that the output electric current of said oxygen sensor is equal to or less than the predetermined value A.

11. A combustion control apparatus for a regenerative combustion apparatus comprising:

a regenerative combustion burner;

air supply and gas exhaust passages connected to said regenerative combustion burner; and an oxygen sensor disposed in one of said regenerative combustion burner and said air supply and gas exhaust passages, wherein a recess is formed in one of said regenerative combustion burner and said air supply and gas exhaust passages connected to said regenerative combustion burner, and said oxygen sensor is disposed in said recess.

12. A combustion control apparatus according to claim 11, wherein said regenerative combustion burner has a heat storage member which straightens a gas flow passing therethrough, and wherein a member constructed and arranged to disturb said gas flow from said heat storage member is disposed at a location close to said recess.

13. A combustion control apparatus for a burner using an oxygen sensor, comprising:

an oxygen sensor including a solid electrolyte;

an imposed electrical voltage switching device constructed and arranged to switch an electrical voltage imposed on said oxygen sensor between a first electrical voltage used when controlling an air ratio and a second electrical voltage used when inspecting unburnt components, said second electrical voltage being equal to or near 0 volts; and a monitoring device constructed and arranged to monitor a concentration of unburnt components included in exhaust gas according to a negative output electrical voltage of said oxygen sensor when said electrical voltage imposed on said oxygen sensor is at said second electrical voltage.

14. A combustion control apparatus according to claim 13, further comprising an air ratio control device conducting an air ratio control when said electrical voltage imposed on said oxygen sensor is at said first electrical voltage.

15. A combustion control apparatus according to claim 13, further comprising an oxygen sensor reviving device constructed and arranged to determine whether said oxygen sensor is in an abnormal condition and to revive said oxygen sensor when said oxygen sensor is in the abnormal condition.

16. A combustion control method according to claim 3, further comprising during said controlling of the air ratio, inspecting for degraded performance of said oxygen sensor and for a problem with said combustion apparatus is performed.

17. A combustion control method according to claim 16, wherein said inspecting includes:

determining whether combustion is OFF;

determining whether an output electric current of said oxygen sensor is greater than a predetermined value B when it is determined that combustion is not OFF;

instructing a decrease of an air/fuel ratio when it is determined that the output electric current of said oxygen sensor is greater than the predetermined value B;

instructing an increase of the air/fuel ratio when it is determined that the output electric current of said oxygen sensor is equal to or less than the predetermined value B;

determining whether the output electric current of said oxygen sensor is equal to or less than a predetermined value C which is smaller than said predetermined value B after said instructing an increase;

instructing a system shutdown when it is determined that the output electric current of said oxygen sensor is equal to or less than the predetermined value C;

determining whether the output electric current of said oxygen sensor is greater than a predetermined value A which is greater than said predetermined value B when it is determined that combustion is OFF;

instructing continuance of operation when it is determined that the output electric current of said oxygen sensor is greater than the predetermined value A; and expressing that said oxygen sensor has degraded and instructing a necessary system shutdown when it is determined that the output electric current of said oxygen sensor is equal to or less than the predetermined value A.

18. A combustion control apparatus for a regenerative combustion apparatus comprising:

a regenerative combustion burner;

air supply and gas exhaust passages connected to said regenerative combustion burner; and an oxygen sensor disposed in one of said regenerative combustion burner and said air supply and gas exhaust passages;

an imposed electrical voltage switching device constructed and arranged to switch an electrical voltage imposed on said oxygen sensor between a first electrical voltage used when controlling an air ratio and a second electrical voltage used when inspecting unburnt components, said second electrical voltage being equal to or near 0 volts; and a monitoring device constructed and arranged to monitor a concentration of unburnt components included in exhaust gas according to a negative output electrical voltage of said oxygen sensor when said electrical voltage imposed on said oxygen sensor is at said second electrical voltage.

19. A combustion control apparatus according to claim 18, further comprising an air ratio control device conducting an air ratio control when said electrical voltage imposed on said oxygen sensor is at said first electrical voltage.

20. A combustion control apparatus according to claim 18, further comprising an oxygen sensor reviving device constructed and arranged to determine whether said oxygen sensor is in an abnormal condition and to revive said oxygen sensor when said oxygen sensor is in the abnormal condition.

* * * * *